US007608372B2

(12) United States Patent
Ishida et al.

(10) Patent No.: US 7,608,372 B2
(45) Date of Patent: Oct. 27, 2009

(54) ELECTROPHOTOGRAPHIC PHOTORECEPTOR, ELECTROPHOTOGRAPHIC IMAGE FORMING METHOD, ELECTROPHOTOGRAPHIC IMAGE FORMING APPARATUS, AND PROCESSING CARTRIDGE

(75) Inventors: Takeshi Ishida, Tama (JP); Kimiyuki Itou, Hino (JP); Fumitaka Mochizuki, Hachioji (JP); Shinichi Yabuki, Sagamihara (JP)

(73) Assignee: Konica Minolta Business Technologies, Inc, Tokyo (JP)

( * ) Notice: Subject to any disclaimer, the term of this patent is extended or adjusted under 35 U.S.C. 154(b) by 254 days.

(21) Appl. No.: 11/259,243

(22) Filed: Oct. 26, 2005

(65) Prior Publication Data

US 2006/0127782 A1 Jun. 15, 2006

(30) Foreign Application Priority Data

Dec. 13, 2004 (JP) ..... 2004-360169
Jan. 11, 2005 (JP) ..... 2005-003508

(51) Int. Cl.
*G03G 15/04* (2006.01)

(52) U.S. Cl. ..... 430/66; 430/65; 430/58.85; 430/58.05; 430/60

(58) Field of Classification Search ..... 430/65, 430/66, 58.05, 58.85, 60, 67
See application file for complete search history.

(56) References Cited

U.S. PATENT DOCUMENTS 6,261,729 B1 * 7/2001 Yuh et al. ..... 430/65
6,331,371 B1 * 12/2001 Matsui ..... 430/65
2002/0102108 A1 * 8/2002 Adachi et al. ..... 399/50
2003/0073014 A1 * 4/2003 Fujita et al. ..... 430/65
2003/0232262 A1 * 12/2003 Yamada et al. ..... 430/58.2

FOREIGN PATENT DOCUMENTS

| | | |
|---|---|---|
| JP | 6175380 | 6/1994 |
| JP | 06175380 | 6/1994 |
| JP | 7300645 | 11/1995 |
| JP | 2002107986 | 4/2002 |
| JP | 2003029439 | 1/2003 |
| JP | 2003195537 | 7/2003 |
| JP | 2003287914 | 10/2003 |

OTHER PUBLICATIONS

English translation of Jp 07-300645 published Nov. 14, 1995 and cited on applicant's Ids filed Apr. 10, 2008.*

* cited by examiner

*Primary Examiner*—Mark F Huff
*Assistant Examiner*—Peter L Vajda
(74) *Attorney, Agent, or Firm*—Lucas & Mercanti, LLP

(57) ABSTRACT

Provided are a photoreceptor, an image forming method, an image forming apparatus and a processing cartridge exhibiting an excellent effect on high quality toner images with no image defect caused by occurrence of fog, lowered image density and sharpness, or generation of black spots. Disclosed also is an electrophotographic photoreceptor including an electrically conductive support containing aluminum, an uppermost layer, and at least an intermediate layer containing inorganic particles and binder, the intermediate layer being provided between the support and the uppermost layer, wherein the support has on a surface of the support crystallizing material particles having a diameter of 0.3-10 μm in an amount of being 0.5-20 per $(20\ \mu m)^2$, the inorganic particles have a number average primary particle diameter of 5-300 nm, the intermediate layer is an insulating layer and covered by the uppermost layer.

19 Claims, 5 Drawing Sheets

ELECTROPHOTOGRAPHIC PHOTORECEPTOR, ELECTROPHOTOGRAPHIC IMAGE FORMING METHOD, ELECTROPHOTOGRAPHIC IMAGE FORMING APPARATUS, AND PROCESSING CARTRIDGE

TECHNICAL FIELD

The present invention relates to an electrophotographic photoreceptor, an electrophotographic image forming method, an electrophotographic image forming apparatus, and a processing cartridge.

BACKGROUND

As a photoreceptor used for electrophotography, commonly known is a photoreceptor in which a photoreceptor employing a photosensitive layer containing an inorganic photoconductive material or an organic photoconductive material is provided on a plate-shaped, a belt-shaped, or a drum-shaped aluminum support.

Electrophotographic performance of the above photoreceptor is largely influenced by the surface condition of an aluminum support as well as the photoreceptor.

When unevenness and scratches occur on the support surface because of insufficient mechanical smoothness, electrical defects, for example, are generated, whereby black spots, black streaks and such are observed. Thus, a mirror-finished process is usually carried out by a diamond tool and so forth. It is commonly known that Mg, Fe, Si, Cu, and Mn are also contained as an alloy composition to obtain desired mechanical strength of an aluminum support. In the case of an alloy component such as Fe or Si, however, not only a number of thin crystallizing materials are formed in the process of support treatment conducted by extrusion molding or drawing molding, but an aluminum melt tends to be formed around these crystallizing materials, via formation of an aluminum alloy. When a photosensitive layer is provided on those crystallizing materials and the aluminum melt around them to form images, image defects tend to be generated.

It is proposed, for example, that the amount of Fe component is not more than 0.2% by weight, and that of Si component is not more than 0.1% by weight (Refer to Patent Document 1, for example.). It is also proposed that a diameter and an area ratio of the crystallizing material are not more than 3 μm and not more than 0.5% (Refer to Patent Document 2, for example.).

However, it was difficult to obtain a high quality toner image, even though the amount of the alloy component, and the diameter and the area ratio of the crystallizing material are specified.

Commonly known is a technique in which various defects on an aluminum support are covered, and an intermediate layer containing polyamide resin, vinyl acetate, or such is provided for the purpose of adjusting an image obtained when the technique is used for a photoreceptor (Refer to Patent Document 3, for example.).

In the case of a photoreceptor in which the above intermediate layer is provided, however, though a problem originated from defects on the support is solved, there is another problem causing image deterioration via increased residual potential and a lowered charging and charge retention property, since fatigue and degradation of images occur easily in the process of forming images repeatedly.

Proposed is a photoreceptor in which a hydrated aluminum oxide layer is also provided on an aluminum support, and a photosensitive layer containing a charge generation material and a charge transfer material is provided thereon (Refer to Patent Document 4, for example.). It is described that the foregoing hydrated aluminum oxide layer is also formed via pure water treatment approximately at 100° C., for example, and high sensitivity, excellent charging and charge maintaining properties, and repeating characteristics can be added to a photoreceptor via simple and easy hydrated processes and rectifying characteristics.

In the case of the photoreceptor employing an aluminum support having the foregoing hydrated aluminum oxide layer thereon, however, occurrence of image defects such as black spots and the like was observed under heavy-duty conditions (30° C. and 80% RH or 10° C. and 20% RH, for example), or during repeated use, when an image was formed by a reversal development method, contrary to an excellent property possessed in view of electrophotographic performance as described above. In the case of a copy machine or a printer employing laser light, for example, there was a problem that fog or density unevenness caused by a group of black spots was observed, though spot image exposure was conducted on a photoreceptor, a dot electrostatic image was formed, to conduct an image formation process by developing this via a reversal development method.

An electrophotographic photoreceptor in which a hydrated aluminum oxide alloy layer is provided on the surface of an electrically conductive support containing an aluminum alloy, and a photosensitive layer is provided thereon, wherein a diameter of crystallizing material particles contained in the aluminum alloy on the surface of the foregoing electrically conductive support is not more than 5 μm, and an area ratio occupied by the foregoing crystallizing material particles, based on the aluminum alloy on the surface of the foregoing electrically conductive support, is not more than 2% (Refer to Patent Document 5, for example.).

But, There was another problem that black spots were generated when a toner image was formed at high temperature and high humidity (30° C. and 80% RH, for example).

It is disclosed that a subbing layer (an intermediate layer) is provided in a photographic photoreceptor to control electrical conductivity between an electrically conductive support and a photosensitive layer, and also to enhance an adhesive power between an electrically conductive support and a charge generation layer. The charge generation layer and the charge transfer layer tend to be peeled off from the layer ends. To solve this problem, a method for forming a photoreceptor is described so as to provide the end of a photosensitive layer to the inward side of the end of an intermediate layer (Refer to Patent Document 6, for example.).

In the case of employing a subbing layer containing titanium oxide particles and such, for example, there is a problem that particles on the surface of a subbing layer are removed via abrasion of the subbing layer during image formation since the subbing layer is exposed, so that the surface of a electrophotographic photoreceptor is contaminated. Further, it is also seen as a problem that black spots are generated in the images of such a photoreceptor during image formation. There is also a problem that a toner adheres easily to the subbing layer during image formation, and it is difficult to clean up the attached toner, so that the toner is deposited at the end portion, whereby fog caused by insufficient toner cleaning is generated.

In relation to the photoreceptor in which an intermediate layer (a subbing layer) containing particles and a photosensitive layer are laminated on a support in this order, it has been investigated that removal of the particles from the intermediate layer is inhibited by covering the intermediate layer with the photosensitive layer, electrical conductivity is controlled via the intermediate layer, and adhesiveness is maintained. It is described that removal of particles (titanium oxide particles, for example) can be inhibited, maintaining the electrical conductivity control via an intermediate layer and adhesiveness, when titanium oxide is specifically employed for particles, and titanium oxide surface-treated by an organic silicon compound and an intermediate layer containing polyamide are used (Refer to Patent Document 7, for example.).

The coated layer end of a photosensitive layer, however, is peeled off during a lot of printing because of insufficient adhesion between a support and the photosensitive layer at the end of the coated layer, since the above resulting photoreceptor, in which an intermediate layer is covered by a photosensitive layer, has a layer structure having the photosensitive layer directly provided on a support, and coated film peeling adversely affect a cleaning capability property as well as development, whereby good quality images can not be obtained.

(Patent Document 1) Japanese Patent O.P.I. Publication No. 64-79339

(Patent Document 2) Japanese Patent O.P.I. Publication No. 1-285953

(Patent Document 3) Japanese Patent O.P.I. Publication No. 2003-345050

(Patent Document 4) Japanese Patent O.P.I. Publication No. 64-29852

(Patent Document 5) Japanese Patent O.P.I. Publication No. 6-3845

(Patent Document 6) Japanese Patent O.P.I. Publication No. 59-184359

(Patent Document 7) Japanese Patent O.P.I. Publication No. 2002-107986

SUMMARY

It is an object of the present invention to provide a electrophotographic photoreceptor (hereinafter referred simply to as a photoreceptor), an electrophotographic image forming method (hereinafter referred simply to as an image forming method), an electrophotographic image forming apparatus (hereinafter referred simply to as an image forming apparatus) and a processing cartridge in which the photoreceptor comprising an intermediate layer containing inorganic particles having a specific number average primary particle diameter, an electrically conductive support containing aluminum (hereinafter referred simply to as a support) accompanied with the specified number and size of crystallizing material particles on the aluminum surface, and a layer structure having the intermediate layer covered by an uppermost layer, capable of obtaining high quality toner images after a lot of printing.

BRIEF DESCRIPTION OF DRAWINGS

Embodiments will now be described, by way of example only, with reference to the accompanying drawings which are meant to be exemplary, not limiting, and wherein like elements numbered alike in several figures, in which.

DETAILED DESCRIPTION OF THE EXEMPLARY EMBODIMENTS

Figure 1:
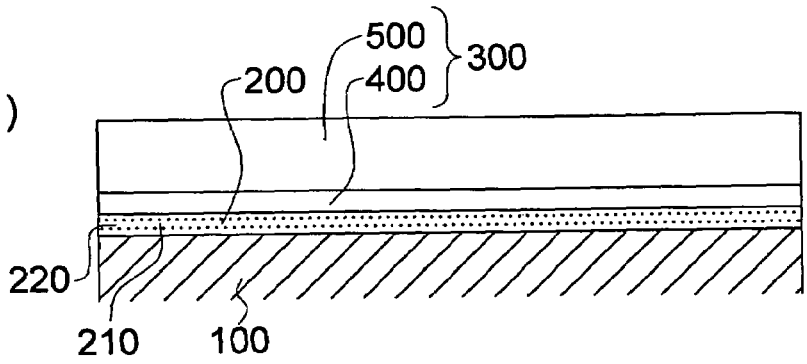
FIGS. 1(*a*)-1(*d*) are schematic diagrams showing examples of the layer structure in a photoreceptor of the present Invention, FIG. 2(*e*) is a schematic diagram of a photoreceptor showing an example of the comparative layer structure.
Figure 1:
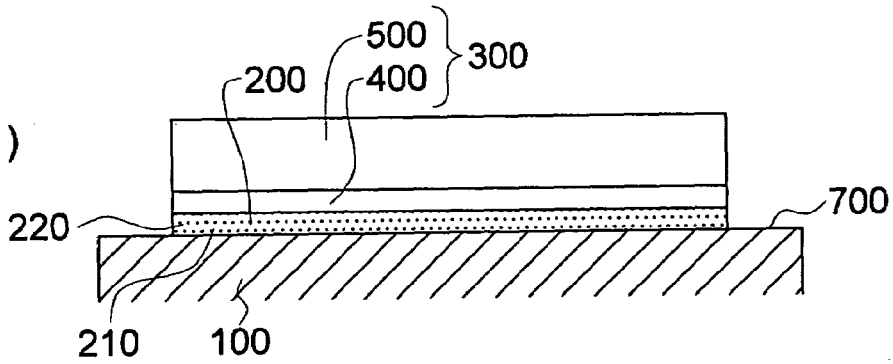
Figure 1:
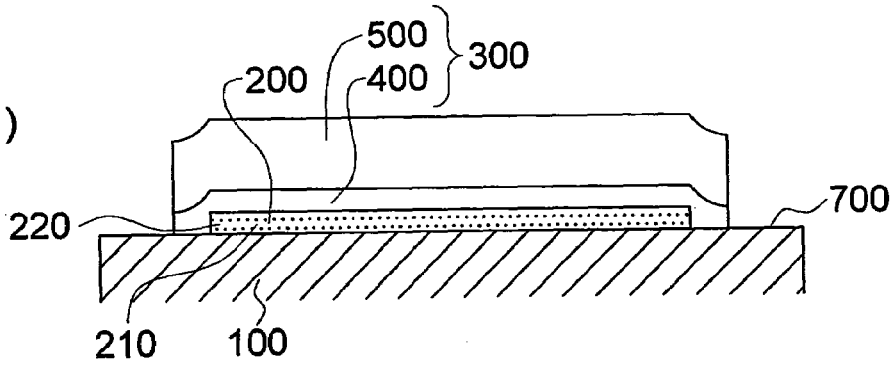
Figure 1:
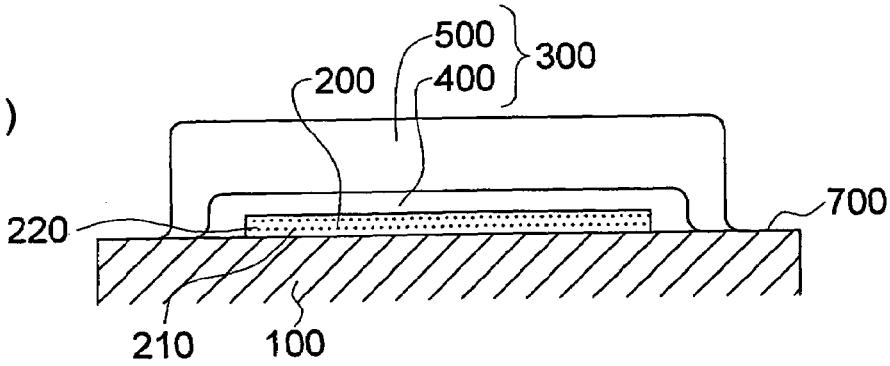

The inventors have intensively investigated a photoreceptor with no occurrence of toner adhesion and insufficient toner cleaning in order to obtain high quality toner images, even though an intermediate layer containing inorganic particles is provided between a support and a photosensitive layer.

Specifically, a photoreceptor in which a photosensitive layer is not peeled off from the end of a coated layer is to be prepared, even in a layer structure in which an intermediate layer is not exposed on the surface of a support to have no occurrence of toner adhesion and insufficient toner cleaning.

Through various intensive studies, it was found that adhesiveness between a support and a photosensitive layer was improved, when a photosensitive layer was provided on the surface of a support in which the number and the diameter of crystallizing material were controlled.

This reason has not been solved yet. However, the support surface is roughened, and adhesiveness between the support and the photosensitive layer is presumably improved when crystallizing materials appear on the support surface.

For this reason, in order to obtain a high quality image, an intermediate layer containing inorganic particles is provided between a support and a photosensitive layer, and is covered by the photosensitive layer, so that a photoreceptor with no formation of fog caused by occurrence of toner adhesion and insufficient toner cleaning can be prepared.

In order to obtain a high quality image, an intermediate layer containing inorganic particles having the number average primary particle diameter of 5 to 300 nm is also provided between the support and the outermost layer containing polyarylate or polyarylate copolymer, and is covered by the outermost layer, so that a photoreceptor with no formation of fog caused by occurrence of toner adhesion and insufficient toner cleaning is possibly prepared.

In the case of the photoreceptor of the present invention, an intermediate layer is covered by a photosensitive layer. What an intermediate layer is covered by a photosensitive layer means that the photosensitive layer is formed on the intermediate layer, the entire intermediate layer including at least one end of the layer is substantially covered, and the exposed portion does not exist at all. Even though both ends of an intermediate layer and a photosensitive layer are placed approximately at the same position, the surface of the intermediate layer in the direction of the support axis may be substantially covered by the photosensitive layer. When the photosensitive layer is a so-called multi-layered type layer, the intermediate layer may be covered by both a charge generation layer and a charge transfer layer, or either a charge generation layer or a charge transfer layer. The entire intermediate layer including both ends of the layer is preferred to be covered.

Accordingly an embodiment is a photoreceptor which has following features: an intermediate layer containing inorganic particles having a number average primary particle diameter of 5-300 nm disposed over an electrically conductive support containing aluminum, the support has on its surface crystallizing material particles having a diameter of 0.3-10 μm and the number of particles being 0.5-20 per (20 μm)$^2$, the end of the intermediate layer is covered by a photosensitive layer, whereby the end of a photosensitive layer is not peeled off via providing a layer structure, and a cleaning capability property can be acquired. As the result, provided are a photoreceptor, an image forming method, an image forming apparatus, and a processing cartridge by which high quality toner images accompanied by no occurrence of fog caused by insufficient toner cleaning after a lot of printing, high density, improved sharpness, and no generation of black spots can be prepared.

On the one hand, a photoreceptor of the present invention, in which an intermediate layer containing inorganic particles having a number average primary particle diameter of 5-300 nm is provided between an electrically conductive support containing aluminum (hereinafter referred simply to as a support) and an photosensitive layer containing a polyarylate resin or a polyarylate copolymer resin, possesses a layer structure in which the end of the intermediate layer is covered by an uppermost layer This photoreceptor, in which a coated layer is not peeled off easily from the end of the coated layer, is capable of exhibiting an excellent toner cleaning property via no occurrence of toner adhesion and damages of a cleaning blade. As the result, high quality toner images accompanied by no occurrence of fog caused by insufficient toner cleaning after a lot of printing, high density, improved sharpness, and no generation of black spots can continuously be prepared.

The present invention will now be detailed.

[Electrically Conductive Support]

An electrically conductive support contains aluminum and crystallizing material particles on the surface of the support. The diameter of the crystallizing material particles is about 0.3-10 μm, preferably 0.5-9 μm, and more preferably 1-5 μm. The number of crystallizing material particles is 0.5-20 per (20 μm)$^2$, preferably 1-10 per (20 μm)$^2$, and more preferably 1-5 per (20 μm)$^2$. The support is preferably constituted of aluminum. The support may contain other material such as Fe, Si in small amount or be covered by aluminium oxide on the surface, as long as the effect of the invention is obtained.

A photoreceptor possessing improved adhesiveness between a support and a photosensitive layer and a high quality image can be prepared by providing a support having the diameter and the number of crystallizing material particles in the above range.

Incidentally, the crystallizing material particle means a crystallized particle obtained by forming an aluminum alloy via an extrusion molding process, a drawing process, and a washing process conducted for alloy components of Fe, Si, and so forth contained in the support. On the one hand, as for controlling the crystallizing material particle, though the particle size and density depend mostly on the alloy composition, it is commonly known that they also depend on subsequent annealing and hearing processes. It is observed that an amount and size of the crystallizing material particle vary, since usually, temperature of an Al support increases locally via a cutting process. They can also be controlled by introducing an aging process subsequently, and further a washing process. In the present invention, the aging process was employed. Though the number and amount of crystallizing material particles tend to be reduced by conducting the aging process, the degree of reduction depends also on thermal hysteresis of the aluminum support.

Though the number and amount of crystallizing material particles on the surface of a support depend on kinds and the amount of alloy metals contained in an aluminum alloy (Fe or Si content in an Al—Fe system alloy and an Al—Mg—Si system alloy, for example), they can be specifically controlled by conducting a support washing process at a reduced temperature of not more than 80° C., and preferably at not more than 80° C., in addition to the increased temperature at the subsequent cutting process.

The crystallizing material particles were observed with a 1000-power scanning electron microscope (SEM) while 50 spots in the image forming region of the support were randomly selected to observe. The size of particles and the number of particles per (20 μm)$^2$ were obtained from each of 50 micrographs. After acquiring the number of crystallizing material particles through each of 50 micrographs, the total number average was also obtained. After the average number of crystallizing material particles was each obtained from a micrograph, the average number variation range was determined with 50 micrographs in total.

In addition, it is known that the size and the number of crystallizing material particles do not vary, even though an intermediate layer and a photosensitive layer are removed by a solvent or such after providing the intermediate layer and the photosensitive layer on the support via coating with an intermediate layer coating liquid and a photosensitive layer coating liquid.

[Resin to Form Uppermost Layer]

Resins to form the uppermost layer is made of major components of resins composed of polyarylate or polyarylate copolymer.

A polyarylate resin composed of polyarylate or polyarylate copolymer is a polymer made mainly of polyester containing a bisphenol component and an aromatic dicarboxylic acid component.

It is preferable in view of improved adhesiveness with a support and electrophotographic characteristics that such a polyarylate resin having the repeating unit, expressed by following Formula (1), which has not less than 50 mol %, preferably not less than 75 mol %, and more preferably not less than 100 mol %.

Formula (1)

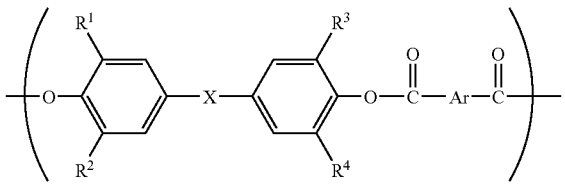

In Formula (1), Ar is an aromatic hydrocarbon group having the carbon number of from 6 to 12, X is at least one group selected from a divalent hydrocarbon group having the carbon number of from 1 to 15, —O—, a sulfone group, and a sulfide group. A ring may also be formed. $R^1$-$R^4$ are the same or different, and are hydrogen, halogen and a hydrocarbon group having the carbon number of from 1 to 5. The direct bonding may also be allowed without X. In Formula (1), a preferable Ar is an aromatic hydrocarbon group having the carbon number of from 6 to 10, and specifically a m-phenylene group, a p-phenylene group, and naphthylene are provided. The m-phenylene group and the p-phenylene group are preferably used.

X is at least one group selected from a divalent hydrocarbon group having the carbon number of from 1 to 15, a sulfone group and a sulfide group, and is specifically selected from the group including a divalent aliphatic hydrocarbon group having the carbon number of from 1 to 15, an alicyclic hydrocarbon group, an alalkylene group, a sulfone group and a sulfide group. An divalent aliphatic hydrocarbon group having the carbon number of from 1 to 10, an aliphatic hydrocarbon group and an alalkylene group are preferably used. Specifically, these examples include an aliphatic hydrocarbon group such as a methylene group, a 1,1-ethylene group, a 2,2-propylene group, a 2,2-butylene group, or a 4-methyl-2,2-pentylene group, an alicyclic hydrocarbon group such as a 1,1-cyclohexylene group or a 3,3,5-trimethyl-1,1-cyclohexylene group, and an alalkylene group such as a 1-phenyl-1,1-ethylene group, a diphenylmethylene group or 1,1-fluorene group.

$R^1$-$R^4$ are the same or different, and are hydrogen, halogen and a hydrocarbon group having the carbon number of from 1 to 5. Specifically, hydrogen, bromine, a methyl group, and such are preferably provided.

In view of solubility to the major solvent of 1,3-dioxolane in the present invention, doping stability, and ease of material availability, $R^1$-$R^4$ are the same or different, and are hydrogen or a methyl group. X is a divalent aliphatic hydrocarbon group having the carbon number of from 1 to 10, or an alicyclic hydrocarbon group, or the direct bonding may also be allowed without X, and Ar is preferably combined with an m-phenylene group or a p-phenylene group. Provided is what is obtained from the repeating unit expressed by following Formula (2), in which either $R^1$ or $R^2$ is a methyl group, either $R^3$ or $R^4$ is a methyl group, and Ar is an m-phenylene group and/or a p-phenylene group. ($R^2$, $R^4$, and X are the same as provided above.)

Formula (2)

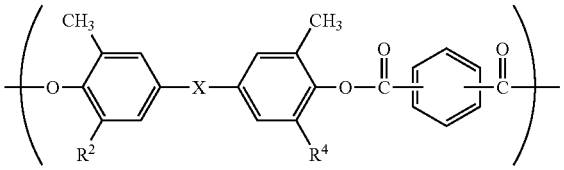

X in Formula (1) is an alicyclic hydrocarbon group such as a 1,1-cyclohexylene group or a 3,3,5-trimethyl-1,1-cyclohexylene group, each of $R^1$-$R^4$ is hydrogen, and Ar is a m-phenylene group or a p-phenylene group. What is obtained from the repeating unit expressed by following Formula (3) can preferably be exemplified in the same manner.

Formula (3)

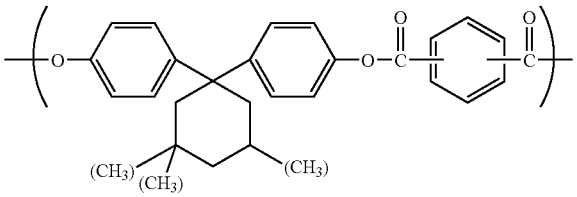

Polyarylate resin used in the present invention may be a copolymer or an admixture having one kind or not less than two kinds of the repeating unit expressed by Formula (1), and may specifically be a copolymer containing not less than two kinds of different bisphenol components. When the copolymer is specifically used, a coating liquid can suitably be usable, since solubility to a solvent for the polymer and the doping stability are improved. In this case, provided is a copolymer containing either one kind of component of the two kinds of 10-99 mol %, and preferably 30-99 mol %, having the repeating unit expressed by Formula (2) and Formula (3) provided as a preferable structure. Preferred as a residual component contained in the copolymer is, in this case, the repeating unit in which each of $R^1$-$R^4$ is hydrogen, X is a 2,2-propylene group, and Ar is a m-phenylene group and/or a p-phenylene group.

The above polyarylate resin may be polyester carbonate obtained from the repeating unit, expressed by following Formula (4), which has not less than 50 mol %, or preferably not less than 25 mol %.

Formula (4)

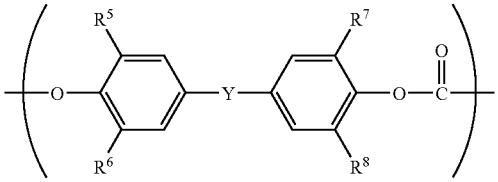

Y in Formula (4) is used as a synonym for X in Formula (1). $R^1$-$R^4$ are the same or different, and are hydrogen, halogen and a hydrocarbon group having the carbon number of from 1 to 5. Y in Formula (4) is used as a synonym for X in Formula (1), and is selected from the group including a divalent aliphatic hydrocarbon group having the carbon number of from 1 to 10, an alicyclic hydrocarbon group and an alalkylene group. Specifically, these examples include an aliphatic hydrocarbon group such as a methylene group, a 1,1-ethylene group, a 2,2-propylene group, a 2,2-butylene group, or a 4-methyl-2,2-pentylene group, an alicyclic hydrocarbon group such as a 1,1-cyclohexylene group or a 3,3,5-trimethyl-1,1-cyclohexylene group, and an alalkylene group such as a 1-phenyl-1,1-ethylene group, a diphenylmethylene group or 1,1-fluorene group.

$R^5$-$R^8$ are the same or different, and are hydrogen, halogen and a hydrocarbon group having the carbon number of from 1 to 5. Specifically, hydrogen, bromine, a methyl group, and such are preferably provided.

Polyarylate resin used in the present invention may be a copolymer having the repeating unit expressed by Formula (1) and Formula (4), or an admixture.

Though the above polyarylate resin is usually synthesized via a commonly known method such as interfacial polycondensation, melt polycondensation, or solution polycondensation, it is preferred in view of less-coloring of the acquired polymer that the polyarylate resin in which an aromatic group of the main chain is ester-linked is produced via interfacial polycondensation. Bisphenol dissolved in an alkali aqueous solution coming in contact with aromatic dicarboxylic acid dichloride dissolved in methylene chloride in the presence of boundary motion solvent, for example, is capable of polymerization. On the one hand, a desired polyarylate resin can also be prepared by melt-mixing each polymer having the repeating unit expressed by Formula (1) and Formula (4), though a copolymer having the repeating unit expressed by the foregoing formulae is produced via this interfacial polycondensation.

The following compounds as the polyarylate resin employed for polyarylate binder in the present invention are specifically provided. The present invention, however, is not limited thereto.

P-1

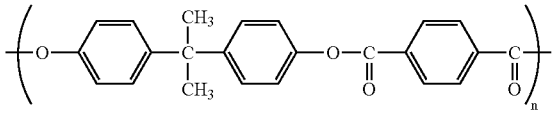

P-2

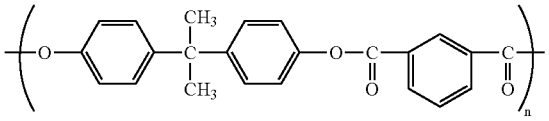

P-3

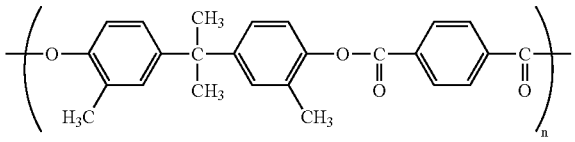

P-4

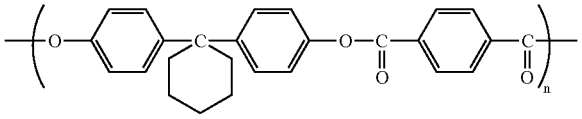

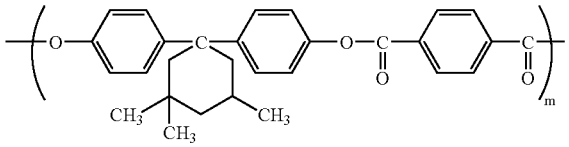

P-5

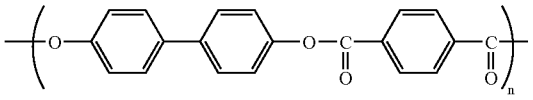

m:n = 50:50

P-6

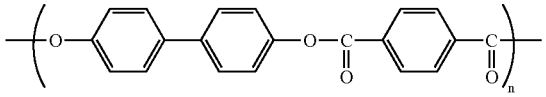

P-7

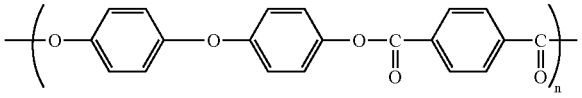

P-8

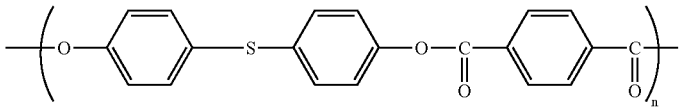

P-9

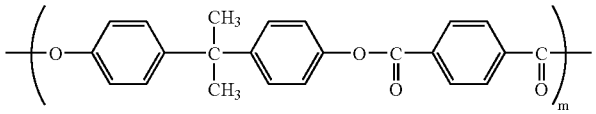

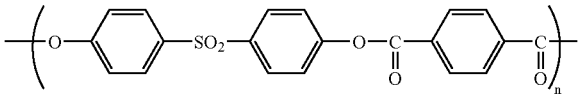

m:n = 50:50

P-10

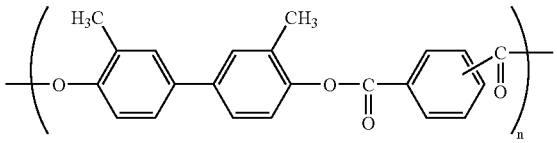

P-11

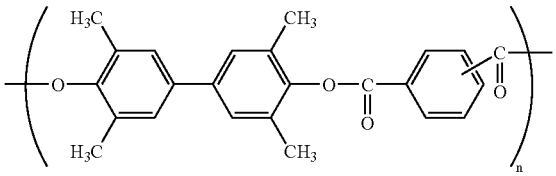

P-12

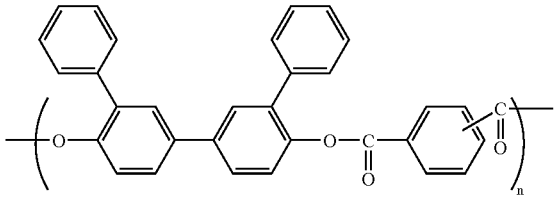

P-13

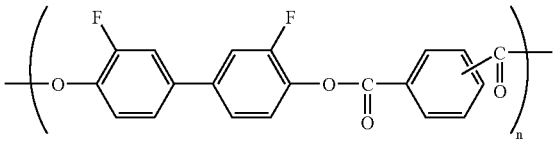

-continued
P-14
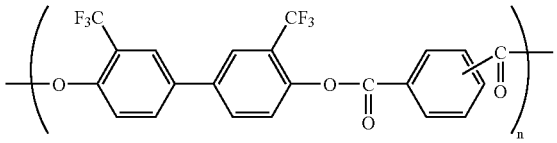
P-15
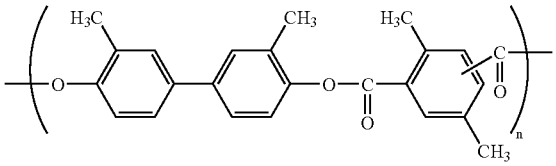
P-16
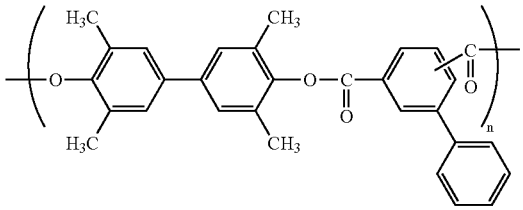
P-17
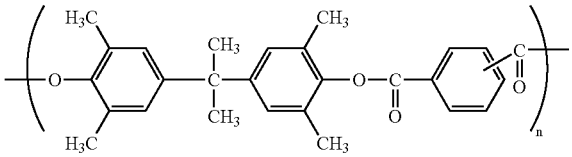
P-18
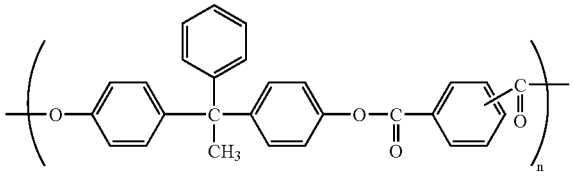
P-19
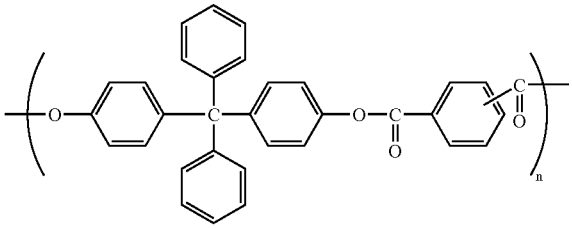
P-20
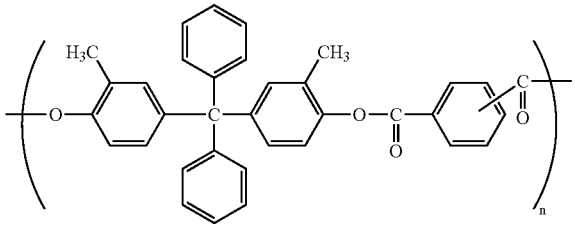
P-21
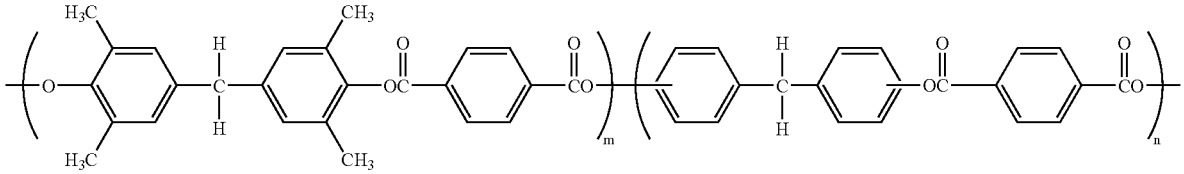
(m:n = 7:3)
P-22
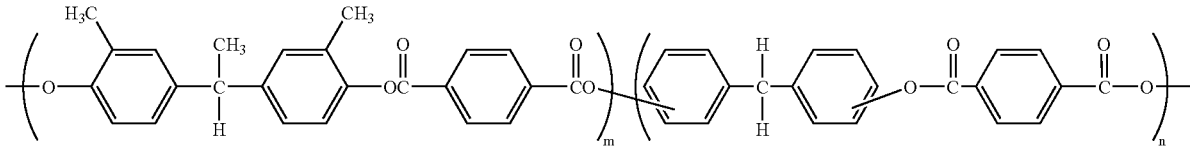
(m:n = 7:3)
P-23
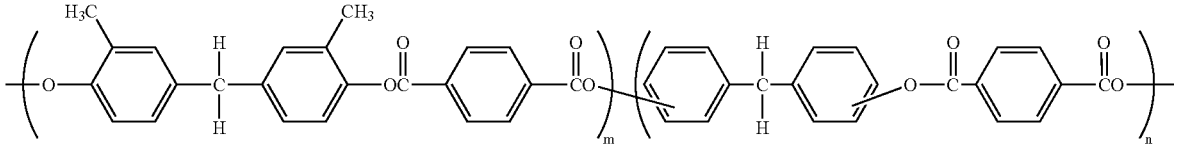
(m:n = 7:3)

-continued

P-24

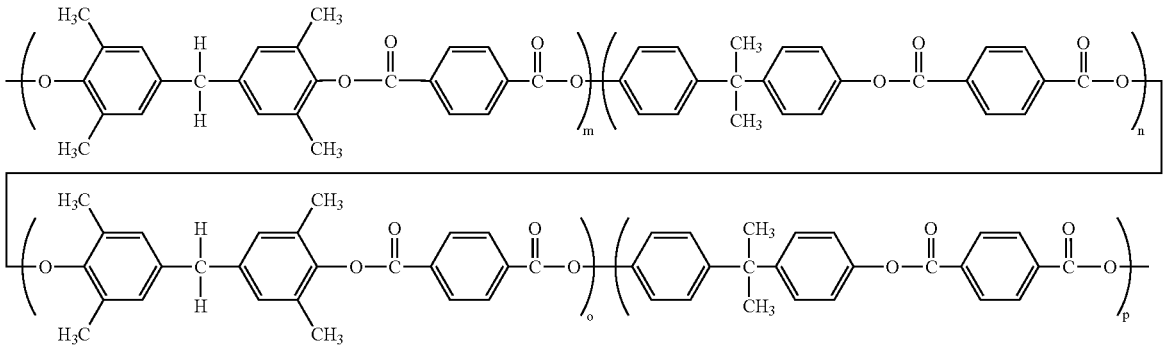

(m:n:o:p = 19:1:1:19)

P-25

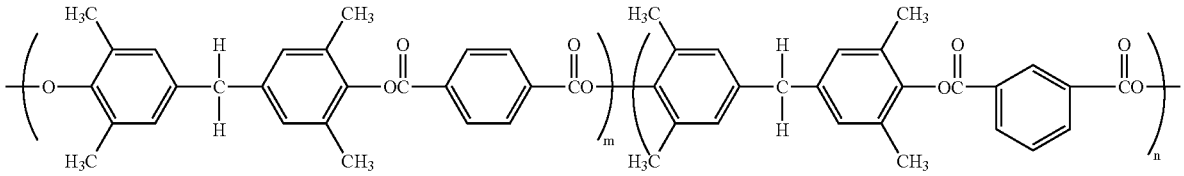

(m:n = 7:3)

P-26

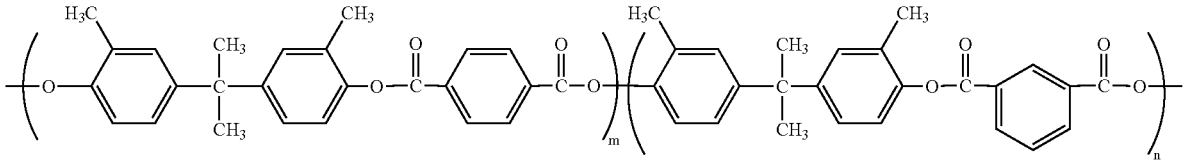

(m:n = 5:5)

As for the molecular weight of a polyarylate resin employed in the present invention, it is preferable that the resin in the range of the number average molecular weight in polystyrene conversion measured by GPC between 10,000 and 500,000, and preferably between 15,000 and 300,000 exhibits excellent solubility, whereby heavy-duty films can be obtained.

[Inorganic Particles]

It is preferable in the present invention that inorganic particles are N-type semiconductive particles.

The N-type semiconductive particle means that main charge carriers are particles of electrons. That is, since main charge carriers are particles of electrons, the intermediate layer in which the N-type semiconductive fine particles are contained in the insulating binder, effectively blocks the hole injection from the substrate and has a property having less blocking capability for the electron from the photosensitive layer.

The following describes the method of identifying the N-type semiconducting particles according to the present invention.

An intermediate layer having a film thickness of 5 μm (intermediate layer formed by using a dispersion having 50 wt % of particles dispersed in the binder resin constituting the intermediate layer) is formed on the substrate (conductive support). This intermediate layer is negatively charged and the light damping property is evaluated. Further, it is positively charged, and the light damping property is evaluated in the same manner.

The N-type semiconducting particles are defined as the particles dispersed in the intermediate layer in cases where the light damping property, when negatively charged in the above evaluation, is greater than that when positively charged.

The N-type semiconductive particles include the particles of titanium oxide ($TiO_2$), zinc oxide (ZnO) and tin oxide ($SnO_2$), and of these, the titanium oxide is preferable.

The inorganic particles having the number average primary particle diameter of 5 to 300 nm are used, and preferably of 10 to 200 nm are used.

The number average primary particle diameter means the measured value obtained as an average value of the FERE diameter according to image analysis. Herein, one hundred particles randomly selected as primary particles were observed with magnification by a factor of 50,000 employing a transmission electron microscope, Since inorganic particles having the foregoing number average primary particle diameter are evenly dispersed in binder, formation of coagulated particles in an intermediate layer and occurrence of unevenness on the surface of the intermediate layer can be inhibited. When coagulated particles are formed in an intermediate layer, the coagulated particles tend to be a charge trap, and a black spot and a transfer memory are easily generated. When unevenness on the surface appears, the black spot tends to be also generated. Further, the inorganic particles do not precipitate easily in an intermediate layer coating liquid.

Titanium oxide is available in various types such as an anatase type, a rutile type, a brookite, and an amorphous type. Of these types, the rutile type titanium oxide is particularly preferred since it enhances rectifying characteristics of charge through the intermediate layer, i.e., mobility of electron, whereby charge potential is stabilized and generation of a transfer memory is prohibited as well as increase of residual potential is prohibited.

Dispersion of inorganic particles according to the present invention is improved via surface treatment. Specifically, the surface treatment is preferable, in which a reactive group such as a hydroxyl group or such being on the surface of the inorganic particle is subjected to reaction with a coupling agent. As the coupling agent, a silane coupling agent, a titanium coupling agent and an aluminum coupling agent are preferred.

For example, isopropyltriisostearoyl titanate, isopropyltris (dioctylpyrophosphate)titanate, isopropyltri(N-aminoethyl-aminoethyl)titanate, tetraoctylbis(ditridecylphosphite)titanate, tetra (2,2-diallyloxymethyl-1-butyl)bis(ditridecyl) phosphite titanate, bis(dioctylpyrophosphate)oxyacetate titanate, bis(dioctylpyrophosphate)ethylene titanate, isopropyltrioctanoyl titanate, isopropyldimethacrylisostearoyl titanate, isopropyltridodecylbenzenesulfonyl titanate, isopropylisostearoyldiacryl titanate, isopropyltri(dioctylphosphate)titanate, isopropyltriacylphenyl titanate and tetraisopropylbis(dioctylphosfie)titanate are usable as the titanium coupling agent.

As the aluminum coupling agent, for example, acetoalkoxyaluminumdiisopropylate is employable.

As the silane coupling agent, for example, vinyltrichlorosilane, vinyltris(β-methoxyethoxy)silane, vinyltriethoxysilane, vinyltrimethoxysilane, γ-methacryloxypropyltrimethoxysilane, β-(3,4-epoxycyclohexyl) ethyltrimethoxysilane, γ-glycidoxypropyltrimethoxysilane, γ-glycidoxypropylmethyldiethoxysilane, N-β-(aminoethyl)-γ-aminopropylmethyldimethoxysilane, γ-aminopropyltriethoxysilane, N-phenyl-γ-aminopropylmethoxysilane, γ-mercaptopropyltrimethoxysilane and γ-chloropropyltrimethoxysilane are employed.

In the case of titanium oxide, prior to the foregoing surface treatment, the surface treatment (primary treatment) may be conducted by at least one selected from alumina, silica and zirconia.

The alumina, silica and zirconia treatments are each the treatment for separating alumina, silica and zirconia on the surface of titanium oxide, respectively. Alumina, silica and zirconia separated out on the surface include alumina hydrate, silica hydrate and zirconia hydrate, respectively.

Via surface treatment of titanium oxide particles carried out at least twice such as the above primary treatment and the subsequent secondary treatment through reaction with the reactive group employing a coupling agent, the surface treatment of titanium oxide particles is uniformly conducted, and an excellent photoreceptor, in which the surface treated titanium particles are sufficiently dispersed and no image defects caused by the black spot are generated, can be acquired.

It is particularly preferred that the alumina treatment is performed at first and followed by the silica treatment, even though the foregoing alumina treatment and silica treatment may be simultaneously applied. When the alumina treatment and silica treatment are separately applied, it is preferred that the amount of the silica is larger than that of the alumina.

The surface treatment of the foregoing titanium oxide conducted by the metal oxide such as alumina, silica or zirconia can be performed by a wet method. The titanium oxide particles having a number average primary particle diameter of 50 nm were dispersed in from 50 to 350 g of water to form aqueous slurry, and a water-soluble silicate or a water-soluble aluminum compound was added to the slurry. And then the slurry is neutralized by adding an alkali or an acid so as to separate silica or alumina onto the surface of the titanium oxide particle. Thereafter, the titanium oxide particles are filtered, washed and dried to obtain the objective surface treated titanium oxide. When sodium silicate is employed as the water-soluble silicate, the neutralization can be carried out by an acid such as sulfuric acid, nitric acid, or hydrochloric acid. When aluminum sulfate is used as the water-soluble aluminum compound, the neutralization can be carried out by an alkali such as sodium hydroxide, potassium hydroxide, or such.

The amount of the metal oxide to be used for the foregoing surface treatment is preferably 0.1-50 parts by weight, more preferably 1-10 parts by weight to 100 parts by weight of the titanium oxide in terms of the weight on the occasion of the start of the foregoing surface treatment.

[Layer Structure of Photoreceptor]

Figure 4:
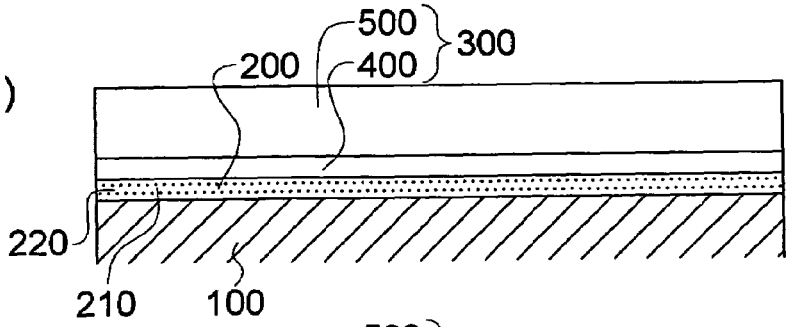
Figure 4:
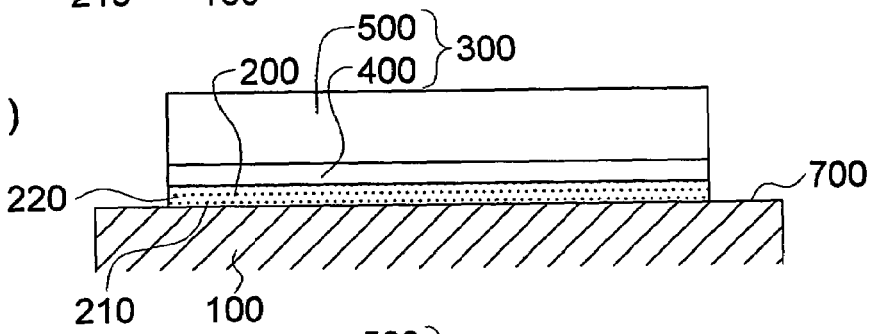
Figure 4:
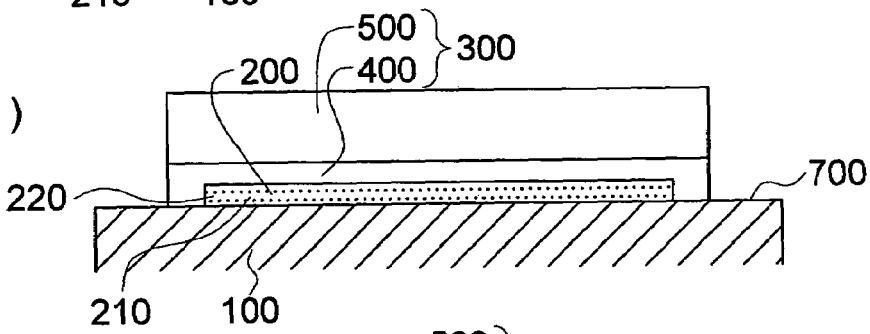
Figure 4:
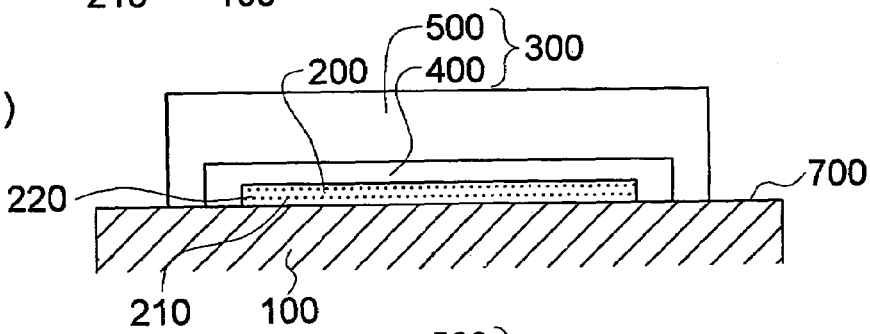
Figure 4:
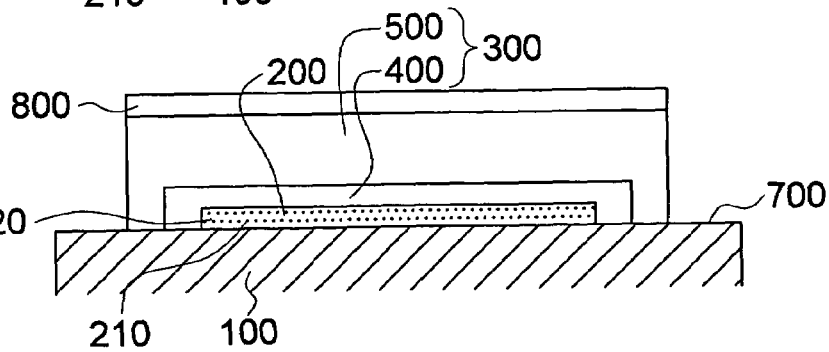

FIG. 4 is also a schematic diagram showing an example of the layer structure in a photoreceptor according to the present invention.

It is shown in FIG. 4 that 100 indicates a support, 200 indicates an intermediate layer, 210 indicates inorganic particles, 220 indicates binder, 300 indicates a photosensitive layer, 400 indicates a charge generation layer, 500 indicates a charge transfer layer, 700 indicates an exposed portion of a support, and 800 indicates a protective layer.

FIG. 4(*a*) is a schematic diagram showing a layer structure in which intermediate layer 200 containing inorganic particle 210 and binder 220 provided up to the end of support 100, and photosensitive layer 300 (charge generation layer 400 and charge transfer layer 500) are formed.

FIG. 4(*b*) is a schematic diagram showing a layer structure in which intermediate layer 200 and photosensitive layer 300 are not provided up to the end of support 100, and exposed portion 700 is provided at the end of the support.

FIG. 4(*c*) is a schematic diagram showing a layer structure in which intermediate layer 200 is not provided up to the end of support 100, the coated layer end of the intermediate layer is covered by photosensitive layer 300, and exposed portion 700 is provided at the end of the support.

FIG. 4(*d*) is a schematic diagram showing a layer structure in which intermediate layer 200 is not provided up to the end of support 100, the coated layer end of the intermediate layer is covered by charge generation layer 400, what is covered is further covered by charge transfer layer 500, charge transfer layer 500 adheres directly to support 200 at the end of the support, and exposed portion 700 is provided at the end of the support.

FIG. 4(*e*) is a schematic diagram showing a layer structure in which protective layer 800 is provided on the charge transfer layer in FIG. 4(*d*), and exposed portion 700 is provided at the end of the support.

Figure 5:
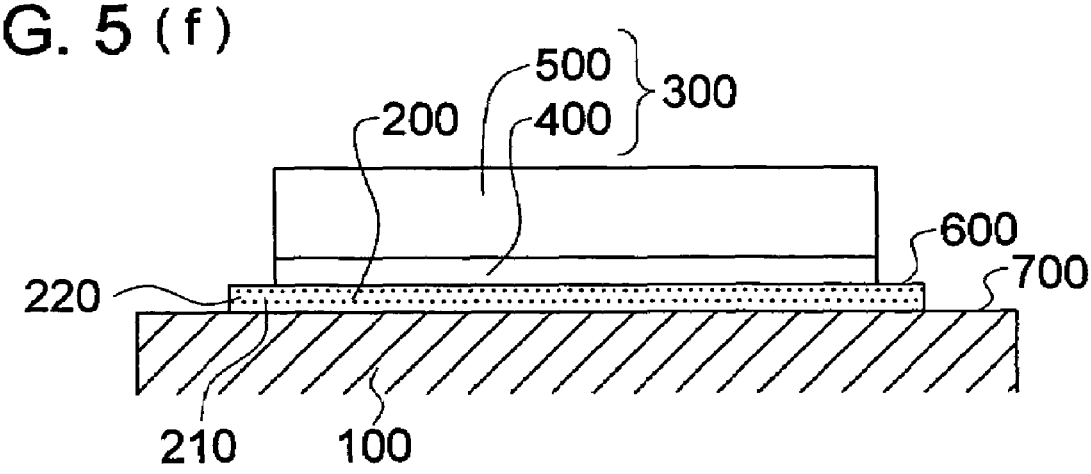

FIG. 5(*f*) is a schematic diagram showing an example of the comparative layer structure in a photoreceptor according to the present invention.

In FIG. 5(*f*), 600 indicates an exposed portion of an intermediate layer.

FIG. 5(*f*) is a schematic diagram showing a layer structure in which intermediate layer 200 is not provided up to the end of support 100, the coated layer end of the intermediate layer is not covered by photosensitive layer 300, exposed portion 600 of the intermediate layer is provided at the end of the support, and exposed portion 700 is provided at the end of the support.

[Preparation of Photoreceptor]

A photoreceptor, covered by an intermediate layer, for example, can be prepared by removing an undesired coated portion after the immersion depth is adjusted by immersion coating, and a coated layer is provided via either circular slide hopper coating (CSH coating) or a combination of immersion coating and CSH coating. However, it is not limited thereto. Incidentally, the above CHS coating is described in Japanese Patent O.P.I. Publication No. 58-189061 in detail.

In the case of the immersion coating, one end depends on the depth penetrated at the upper level or at the lower level via immersion coating, and it is possible that an upper layer can be arranged to be either the intermediate layer or the charge generation layer and the charge transfer layer.

Since another end is totally coated up to the end of a support, if an intermediate layer is desired to be covered, undesired charge generation layer and charge transfer layer may be dissolved, or be removed by a swelling solvent, after the intermediate layer is dissolved, or a coated layer of the intermediate layer is removed by the swelling solvent, and the charge generation layer and the charge transfer layer are subsequently coated.

The method for preparing a photoreceptor having a layer structure in FIG. 4(*d*) will specifically be described.

The 1$^{st}$ step: The depth penetrated via immersion coating is adjusted, an intermediate layer up to 15 mm from the upper end of the support is coated by an intermediate layer coating liquid, and dried to form an intermediate layer.

The 2$^{nd}$ step: The intermediate layer, formed at the lower end of the support, up to 15 mm from the lower end of the support is removed by dissolving the intermediate layer or employing a tape containing a swelling solvent.

The 3$^{rd}$ step: The depth penetrated via immersion coating is adjusted, a charge generation layer up to 13 mm from the upper end of the support is coated, and dried to form a charge generation layer.

The 4$^{th}$ step: The charge generation layer, formed at the lower end of the support, up to 13 mm from the lower end of the support is removed by dissolving the charge generation layer or employing a tape containing a swelling solvent.

The 5$^{th}$ step: The depth penetrated via immersion coating is adjusted, a charge transfer layer up to 10 mm from the upper end of the support is coated, and dried to form a charge transfer layer.

The 6$^{th}$ step: The charge transfer layer, formed at the lower end of the support, up to 10 mm from the lower end of the support is removed by dissolving the charge transfer layer or employing a tape containing a swelling solvent, and coated layer formation of the photoreceptor is completed.

The following material members and layers of which a photoreceptor in the present invention is composed will be described.

(Support)

It is preferable that the shape of a support is cylindrical, and the support is washed after the surface is mirror-finished processed by a diamond tool. In addition, its specific resistance is preferably not more than $10^3$ Ω cm.

[Intermediate Layer]

An intermediate layer is formed by coating and drying the intermediate layer coating liquid containing the foregoing inorganic particles, binder, and a dispersion medium.

The content (ratio) of the inorganic particles in the intermediate layer is preferably from 0.5 to 2.0 times of the binder resin used for the intermediate layer in the volume ratio. By employing the inorganic particles in the intermediate layer in such the volume ratio, a rectifying ability of the intermediate layer is increased so that the increasing of the residual potential and the transfer memory are not caused even when the thickness of the layer is increased, the black spots can be effectively prevented and the suitable photoreceptor with small potential fluctuation can be prepared.

Specifically, in the intermediate layer, 50-200 parts by volume of the inorganic particles are preferably used to 100 parts by volume of the binder resin.

On the one hand, the binder used for the intermediate layer to disperse the above inorganic particles includes polyamide resin, vinyl chloride resin, vinyl acetate, or copolymer resin containing two or more repeating units of these. Of these resins, polyamide resin, which can minimize the residual potential after repeated use, is preferable. Polyamide having a repeating unit structure expressed by following Formula (1') is more preferable.

Formula (1')

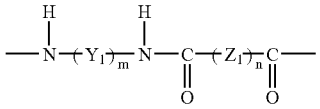

In Formula (1'), $Y_1$ is a di-valent group containing an alkyl-substituted cycloalkane group, $Z_1$ is a methylene group, m is an integer of 1-3 and n is an integer of 3-20.

In the above Formula (1'), the following chemical structure is preferable for $Y_1$ which is represented by a di-valent group containing an alkyl-substituted cycloalkane group, and the polyamide resin having the following chemical structure for $Y_1$ displays charge blocking ability maintained against changes in temperature and humidity and considerable improving effect on the black spot occurrence.

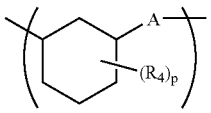

In the above chemical structure, A is a single bond or an alkylene group having from 1 to 4 carbon atoms; $R_4$ is a substituent group occupied by an alkyl group; and p is a natural number of from 1 to 5. Plural $R_4$ may be the same as or different from each other.

Specific examples of the polyamide resin are shown below.

N-1

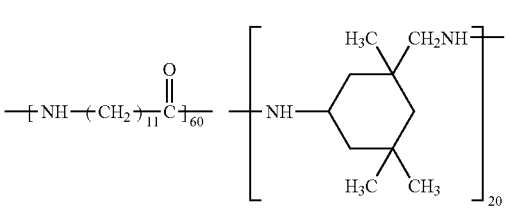

-continued
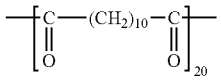
N-2
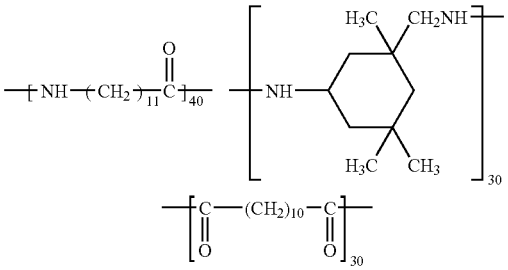
N-3
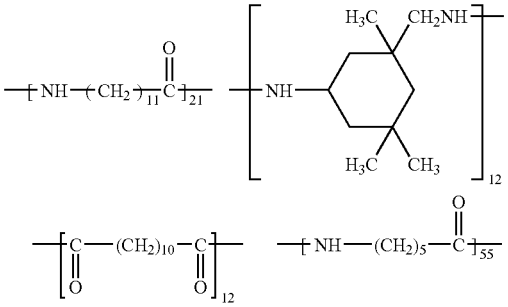
N-4
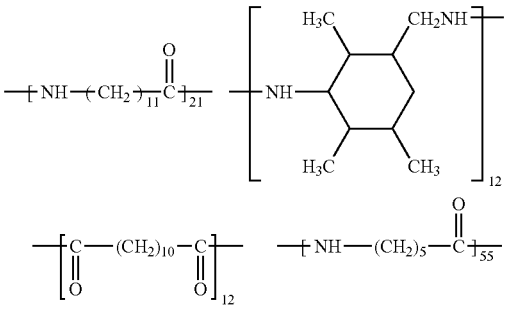
N-5
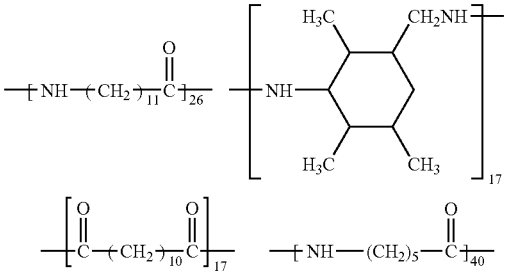
N-6
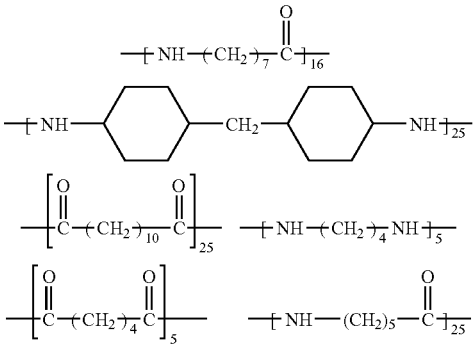
-continued
N-7
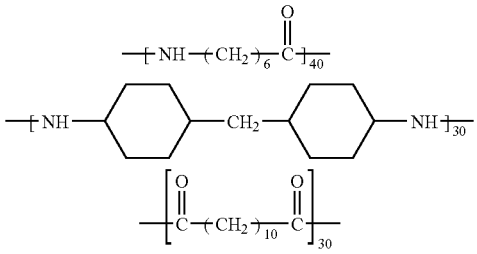
N-8
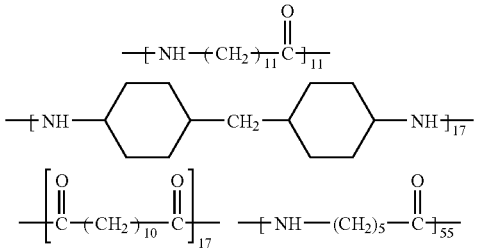
N-9
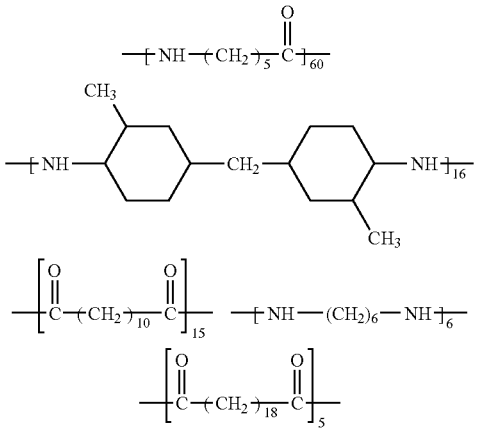
N-10
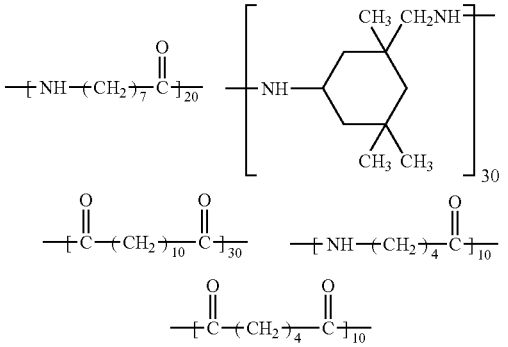
N-11
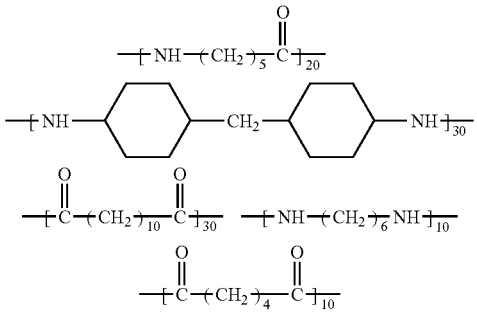

-continued

N-12

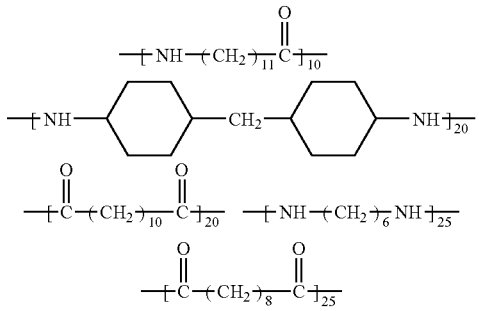

N-13

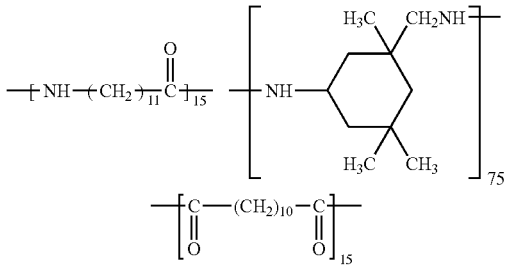

N-14

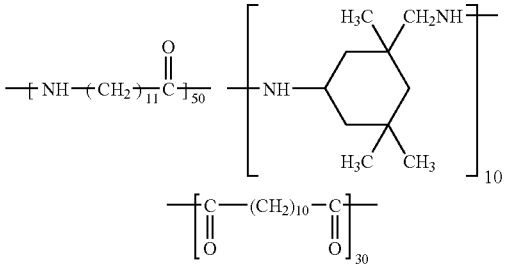

Among the above examples, the polyamide resins of N-1 through N-5, N-9, N-10, N-13, and N-14 having the repeating unit containing an alkyl-substituted cycloalkane group represented by Formula (1) are particularly preferred.

The molecular weight of the polyamide resins is preferably from 5,000 to 80,000, and more preferably from 10,000 to 60,000, in terms of number average molecular weight. Thickness of the intermediate layer can also be prepared evenly by putting number average molecular weight within this range, and formation of the coagulates of the resin in the intermediate layer and occurrence of the image defects such as black spots are inhibited.

It is preferable that the solvent for preparing the intermediate layer coating liquid is capable of dispersing inorganic particles sufficiently and dissolving the polyamide resin. Alcohols having 2-4 carbon atoms such as ethanol, n-propyl alcohol, iso-propyl alcohol, n-butanol, t-butanol and sec-butanol are preferable from the aspect of the solubility of the polyamide resin and the coating performance. The above solvent of 30-100% by weight, preferably 40-100% by weight, or further preferably 50-100% by weight is contained, based on the entire solvent amount. As solvent aid giving preferable effects when it is used together with the foregoing solvents, methanol, benzyl alcohol, toluene, methylene chloride, cyclohexanone and tetrahydrofuran are preferably employed.

Thickness of the intermediate layer in the present invention is preferably 0.2-40 μm, and more preferably 0.3-20 μm. Generation of black spots is minimized, and increase of residual potential and generation of transfer memory are inhibited by putting thickness of the intermediate layer within this range, whereby toner particles attached to the exposed intermediate layer can be sufficiently cleaned to obtain toner images having high sharpness.

The intermediate layer in the present invention is substantially an insulation layer. The insulation layer described here is a layer having $1\times10^{8}$ Ω·cm or more in volume resistivity. The volume resistivity of the intermediate layer in the present invention is preferably $1\times10^{8}$-$1\times10^{15}$ Ω·cm, more preferably $1\times10^{9}$-$1\times10^{14}$ Ω·cm, and still more preferably $2\times10^{9}$-$1\times10^{13}$ Ω·cm. The volume resistivity can be measured as follows.

Measuring condition: in accordance with JIS C2318-1975

Measuring apparatus: Hiresta IP manufactured by Mitsubishi Chemical Corporation.

Measuring condition: Measuring probe HRS

Applied voltage: 500 V

Measuring environment: 20±2° C., 65±5% R

By putting volume resistivity within the above range, generation of black spots is minimized due to excellent charge blocking ability via the intermediate layer, and increase of residual potential is inhibited even though printing is repeated, since potential maintaining is in good condition, whereby toner particles attached to the exposed intermediate layer can be sufficiently cleaned to obtain excellent quality images having high sharpness.

[Layer Structure]

It a feature that a photoreceptor of the present invention possesses an intermediate layer covered by a photosensitive layer.

What an intermediate layer is covered by a photosensitive layer means that the photosensitive layer is formed on the intermediate layer, the entire intermediate layer including at least one end of the layer is substantially covered, and the exposed portion does not exist at all. Even though both ends of an intermediate layer and a photosensitive layer are placed approximately at the same position, the surface of the intermediate layer in the direction of the support axis may be substantially covered by the photosensitive layer. When the photosensitive layer is a so-called multi-layered type layer, the intermediate layer may be covered by both a charge generation layer and a charge transfer layer, or either a charge generation layer or a charge transfer layer. The entire intermediate layer including both ends of the layer is preferred to be covered.

FIGS. 1(*a*)-1(*d*) show examples of the layer structure in a photoreceptor of the present invention.

It is shown in FIGS. 1(*a*)-1(*d*) FIGS. 1(*a*)-1(*d*) that 100 indicates a support, 200 indicates an intermediate layer, 210 indicates inorganic particles, 220 indicates binder, 300 indicates a photosensitive layer, 400 indicates a charge generation layer, 500 indicates a charge transfer layer, 700 indicates an exposed portion of a support, and 800 indicates a protective layer.

FIG. 1(*a*) is a schematic diagram showing a layer structure in which intermediate layer 200 containing inorganic particle 210 and binder 220 provided up to the end of support 100, and photosensitive layer 300 (charge generation layer 400 and charge transfer layer 500) are formed. FIG. 1(*b*) is a schematic diagram showing a layer structure in which intermediate layer 200 and photosensitive layer 300 are not provided up to the end of support 100, and exposed portion 700 is provided at the end of the support. FIG. 1 (*c*) is a schematic diagram showing a layer structure in which intermediate layer 200 is not provided up to the end of support 100, the coated layer end of the intermediate layer is covered by photosensitive layer 300, and exposed portion 700 is provided at the end of the support.

FIG. 1(*d*) is a schematic diagram showing a layer structure in which intermediate layer 200 is not provided up to the end of support 100, the coated layer end of the intermediate layer is covered by charge generating layer 400, which is covered further by charge transfer layer 500, charge transfer layer 500 adheres directly to support 200 at the end of the support, the exposed portion 700 is provided at the end of the support.

Figure 2:
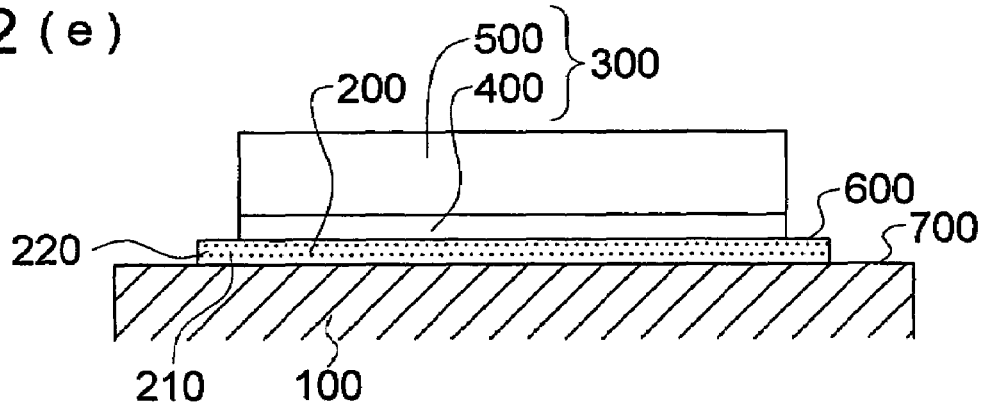

FIG. 2(*e*) is a schematic diagram of a photoreceptor showing an example of the comparative layer structure.

In FIG. 2(*e*), 600 indicates an exposed portion of the intermediate layer.

FIG. 2(*e*) is a schematic diagram showing a layer structure in which intermediate layer 200 is not provided up to the end of support 100, the coated layer end of the intermediate layer is not covered by photosensitive layer 300, exposed portion 600 of the intermediate layer is provided, and exposed portion 700 of the support is also provided.

Incidentally, an electroconductive layer may be provided between a support and an intermediate layer, and a protective layer may also be formed on a charge transfer layer for a photoreceptor of the present invention, if desired. Herein, the electroconductive layer and the protective layer will be explained.

(Electroconductive Layer)

In the case of laser beam exposure employed for image formation, an electroconductive layer is preferably provided between the support and the intermediate layer in order to avoid formation of an interference pattern. An electroconductive layer coating liquid in which electroconductive inorganic particles such as carbon black and metal particles are dispersed in binder is coated on the support and dried to form the electroconductive layer. Thickness of the electroconductive layer is preferably 5-40 μm, and more preferably 5-30 μm.

(Protective Layer)

A protective layer can be formed on a photosensitive layer to improve surface characteristics of a photoreceptor. Thermosetting resin is preferably employed as a binding resin used for the protective layer in view of improving wear resistance against surface hardness of the protective layer, developer, or such. Acryl resin, phenol resin, epoxy resin, urethane resin, or siloxane resin is provided as a binder used for a surface protective layer. Of these, phenol resin is preferably used in order to minimize resistivity variation at not only normal temperature and high humidity but also high temperature and high humidity, whereby an excellent use environment resistance property is obtained.

In addition, a protective layer can be provided on a photosensitive layer to improve surface characteristics of a photoreceptor. The protective layer is to be provided in order to avoid scratches generated by a cleaning blade as well as abrasion by a developer. It is preferred from the aspect. of the purpose of providing a protective layer that a protective layer resin exhibits an excellent abrasion resistance property. Resin formed from polyacrylate or polyarylate copolymers are specifically designed to be major components, and other resins may be mixed, if desired. It is preferable that the number average molecular weight of the resin containing polyarylate or polyarylete copolymner used for a protective layer is higher than the molecular weight employed for a charge transfer layer in a photosensitive layer. Thickness of the protective layer is preferably 1 -8 μm, and more preferably, 2-5 μm.

[Preparation of Photoreceptor]

A photoreceptor, covered by an intermediate layer, for example, can be prepared by removing an undesired coated portion after the immersion depth is adjusted by immersion coating, and a coated layer is provided via either circular slide hopper coating or a combination of immersion coating and circular slide hopper coating. However, it is not limited thereto. Incidentally, the above circular slide hopper coating is described in Japanese Patent O.P.I. Publication No. 58-189061 in detail.

Specifically, in the case of the immersion coating, one end depends on the depth penetrated at the upper level or at the lower level via immersion coating, and it is possible that an upper layer can be arranged to be either the intermediate layer or the charge generation layer and the charge transfer layer.

Since another end is totally coated up to the end of a support, if an intermediate layer is desired to be covered, the intermediate layer coating layer is peeled off by a solvent by which an intermediate layer is easily peeled off, the charge generation layer and the charge transfer layer are subsequently coated, and undesired charge generation layer and charge transfer layer may be peeled off by a solvent by which an intermediate layer is not peeled off. The following material members and layers of which a photoreceptor in the present invention is composed will be described.

(Support)

The number and size of crystallizing material particles on the surface of a support which are used for the support of the present invention are those in the previous range. It is preferred that the shape of the support is cylindrical, and its specific resistance is not more than $10^3$ Ωcm.

(Intermediate Layer)

The foregoing intermediate layer is used as an intermediate layer of the present invention.

(Photosensitive Layer)

The photosensitive layer is preferably a layer in which the function of the photosensitive layer is separately charged to charge generation layer (CGL) and charge transfer layer (CTL), even though the layer may be a single layer provided on the foregoing intermediate layer, which has both of the charge generation function and the charge transfer function. Via the layers functioning separately, the increase of the residual potential after repeated use can be reduced, whereby the electrophotographic properties can be easily controlled for fitting the purpose. In the photoreceptor to be negatively charged, it is preferred that charge generation layer (CGL) is provided on the intermediate layer, and charge transfer layer (CTL) is provided on charge generation layer (CGL). In the photoreceptor to be positively charged, charge generation layer (CGL) and charge transfer layer (CTL) are reversely provided on the intermediate layer. A negatively charging photoreceptor having the layers functioning separately is most preferred, in which CGL and CTL are in this order provided on the interlayer.

Each of the layers in the photosensitive layer of the negatively charging photoreceptor having the layers functioning separately is described below.

Charge Generation Layer

Charge generation layer (CGL) contains charge generation material (CGM). The layer may contain a binder resin and another additive, if desired.

A commonly known charge generation material (CGM) can be employed as a charge generation material. Phthalocyanine pigments, azo pigments, perylene pigments and azulenium pigments are, for example, usable. Among them, CGM capable of minimizing the residual potential after repeated use is one having 3D potential figure which can take a stable coagulation structure between plural molecules thereof. Specifically, phthalocyanine pigments and perylene pigments each having a specific crystal structure are cited as CGM. For example, CGM such as titanyl phthalocyanine having the highest diffraction peak at 27.2° of Bragg angle 2θ of Cu—Kα ray and benzimidazole perylene having the highest diffraction peak at Bragg angle 2θ of 12.4° shows almost no degradation after repeated use, whereby increase of the residual potential can be minimized.

Though a commonly known resin can be employed as a binder, when the binder is used for the charge generation layer as a dispersing medium of CGM, formal resin, butyral resin, silicon resin, silicon-modified butyral resin, or phenoxy resin can be provided as the most preferably usable resin. A ratio of the charge generation material to the binder is preferably 20-600 parts by weight to 100 parts by weight of the binder resin. The residual potential after repeated use can be minimized by using these resins. Thickness of the charge generation layer is preferably 0.01-2 μm.

In addition, a photosensitive layer coating liquid containing charge transfer material (CTM), a binder resin, a dispersion solvent, and such is coated, and dried to form a charge generation layer.

Charge Transfer Layer

The charge transfer layer contains charge transfer material (CTM) and a binder resin in which the CTM is dispersed. Additives such as an antioxidant or so forth as other substances may be contained in the charge transfer layer.

A commonly known charge transfer material (CTM) can be employed as a charge transfer material. Triphenylamine derivatives, hydrazone compounds, benzidine compounds, butadiene compounds and such, for example, can be provided. These charge transfer materials are usually dissolved in an appropriate binder to form the layer. Of these, CTMs, which are capable of minimizing the increase in residual potential under repeated use, are those which exhibit properties such as high mobility as well as an ionization potential difference of not more than 0.5 eV from a combined CGM, and preferably not more than 0.25 eV.

The ionization potential of CGM and CTM is measured employing a surface analyzer AC-1 (manufactured by Riken Keiki Co.).

Cited as resins employed in charge transport layer (CTL) are, for example, polystyrene, acrylic resin, methacrylic resin, vinyl chloride resin, vinyl acetate resin, polyvinyl butyral resin, epoxy resin, polyurethane resin, phenol resin, polyester resin, alkyd resin, polycarbonate resin, silicon resin, melamine resin, and copolymers comprising at least two repeating units of these resins. Other than these insulating resins, high molecular organic semiconductors such as poly-N-vinylcarbazole are also provided.

In addition, a charge generation layer coating liquid containing charge transfer material (CTM), a binder resin, solvent, and such is also coated, and dried to form a charge transfer layer.

Of these, polycarbonate resin is most preferable as a CTL binder. Polycarbonate resin is most preferred because of improved dispersibility of CTM as well as an electrophotographic property. The ratio of a binder resin to charge transport material (CTM) is preferably 10-200 parts by weight to 100 parts by weight of the binder resin. Thickness of the charge transport layer is also preferably 10-40 μm.

A commonly known antioxidant can be employed. Specifically, IRGANOX 1010 manufactured by Nihon Chiba Geigy Co. can be provided.

[Image Formation]

Next, an image forming method, an image forming apparatus, and a processing cartridge will be explained.

Provided is an image forming method in which an image is formed specifically via a charging process to charge the photoreceptor, an exposure process to form an electrostatic latent image via exposing the charged photoreceptor to light, a developing process to form a toner image obtained by developing the electrostatic latent image with a developer containing a toner, and a transfer process to transfer the toner image to a recording material through an intermediate transfer body or not through the intermediate transfer body.

A charging member employed in the above charging process is preferably a charging roller or a magnetic brush to charge in contact.

After conducting the above transfer process, a cleaning process to collect a residual toner remaining on the photoreceptor is preferably not carried out prior to the foregoing charging process.

The foregoing electrophotographic image forming method is preferably used for an image forming apparatus in the present invention.

The electrophotographic receptor is combined with at least any one of a charging means, an exposure means, a development means, a transfer means and a cleaning means, and a processing cartridge of the present invention is preferably capable of being designed to be freely mounted on and to be dismounted from the foregoing electrophotographic image forming apparatus.

Figure 3:
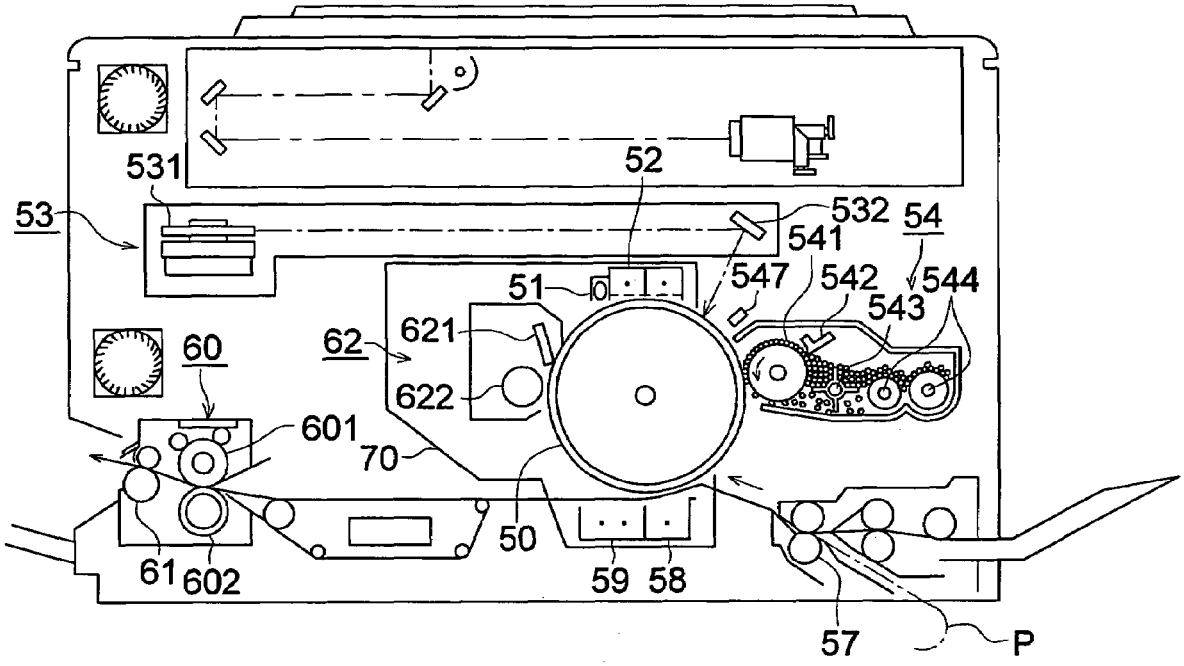
FIG. 3 is a schematic cross-sectional view showing an example of the image forming apparatus according to the present invention, FIG. 4(*a*)-4(*e*) are schematic diagrams showing examples of the layer structure in a photoreceptor according to the present invention, and FIG. 5(*f*) is a schematic diagram showing an example of the comparative layer structure in a photoreceptor according to the present invention.

FIG. 3 is a schematic cross-sectional view showing an example of the image forming apparatus according to the present invention.

In FIG. 3, the numeral 50 is a photoreceptor (photoreceptor drum), and the drum is grounded and driven so as to be rotated clockwise. The numeral 52 is a scorotron charging device (in a charging process) which uniformly gives charge onto the surface of the photoreceptor drum 50 by corona discharge. Prior to uniformly charging with charging device 52, charge remaining on the surface of the photoreceptor may be removed by light exposure via exposure portion prior to charging 51 using a light emitting diode or such to remove the hysteresis of the photoreceptor during the previous image formation.

After the uniform charging, the photoreceptor is imagewise exposed to light by image exposing device 53 (image exposing means in the image exposing process) according to the image information. Image exposing device 53 which is not shown in the drawing has a laser diode as a light source. The photoreceptor is scanned by a light beam turned via rotating polygon mirror 531, an fθ lens and reflecting mirror 532 so as to form an electrostatic latent image.

Then the electrostatic latent image is developed by developing device (development means in the developing process) 54. Developing device 54 storing a developer composed of a toner and a carrier is arranged around photoreceptor 50, and the development is performed by developing sleeve 541 which has a magnet therein and is rotated while carrying the developer.

A reversal development is commonly conducted in a digital image forming method. The reversal development means an image forming method in which the surface of the photoreceptor is uniformly charged by charging device 52, and the exposure portion potential (exposure portion) where the imagewise exposure is performed is visualized via the developing process. On the one hand, unexposed portion potential is not developed due to developing bias potential applied to developing sleeve 541.

The interior of the developing device is constituted by developer stirring member 544, developer conveying member 543 and conveying amount controlling member 542. Though the developer is stirred, conveyed and supplied to the developing sleeve, the supplying amount of the developer is controlled by conveying amount controlling member 542. The conveying amount of the developer is usually within the range of 20-200 mg/cm$^2$ even though the amount is varied depending on the line speed of the electrophotographic photoreceptor and specific gravity of the developer.

The developer is conveyed to a developing zone to develop while the layer thickness is controlled by the conveying amount controlling member. During the developing process, a direct current bias or an alternative bias if desired, is usually applied between photoreceptor drum 50 and developing sleeve 541. The development is conducted under the condition that the developer is either touched or not touched to the photoreceptor. Potential measurements of the photoreceptor are carried out by providing potential sensor 547 above the developing position, as shown in FIG. 3.

Image receiving material P is supplied to the transferring zone by rotating paper supplying roller 57, when the timing for transfer is adjusted after the image formation.

In the transferring zone, synchronized with the timing for transfer, the toner on the surface of the photoreceptor drum 50 is transferred to supplied image receiving material P by a transferring electrode (transferring means: transferring device) 58 which gives charge of opposite polarity to the toner polarity.

Then image receiving material P is discharged by a separating electrode (separator) 59. Image receiving material P is separated from the surroundings of photoreceptor drum 50 and conveyed to fixing device 60. The toner image is melted and adhered to the image receiving material via heating and pressing with heating roller 601 and pressure roller 602, and the image receiving material is output from the apparatus via exhausting roller 61. The primary operation is suspended after passing of image receiving material P, transferring electrode 58 and separating electrode 59 are to be prepared to form the next toner image. In FIG. 3, a corotron transfer electrode is used for transfer electrode 58. Though the setting condition of the transfer electrode depends on a processing speed (peripheral speed) of the photoreceptor and can not simply be determined, the transfer current, for example, is set to be from +100 to +400 μm, and the transfer voltage is also set to be from +500 to +2000 V.

On the one hand, after separation of image receiving material P, the residual toner is removed by blade 621 and brush 622 of a cleaning device (cleaning means) 62, pressing the drum surface, and the drum surface is cleaned. The photoreceptor is subjected to being discharged by exposure portion prior to charging 51 and being charged by charging device 52 to move to the next image forming process.

Incidentally, the numeral 70 shows a processing cartridge, capable of being designed to be freely mounted on and to be dismounted from the image forming apparatus, which possesses the charging device, transferring device, the separating device and the cleaning device in an integrated combination.

A recording material employed in the present invention means a support retaining a toner image, which is commonly called an ordinary image support, a transfer member, or a transfer sheet. Though provided specifically are various image receiving materials such as plain paper sheets from a thin paper sheet to a thick paper sheet, an art paper sheet, printing paper sheets of a coated paper sheet and such, commercially viable Japanese paper or post card paper sheet, a plastic film sheet for OHP, and cloth, they are not limited thereto.

A developer employed in the present invention may be either a single component developer or a two-component developer.

In the case of a single component developer, a magnetic single component developer containing magnetic particles having a size of about 0.1 to about 5 μm in a non-magnetic single component developer or a toner is provided. Both a single component developer and a two-component developer, however, can be used.

In the case of a two-component developer, 3-20 parts by weight of toner are blended with 100 parts by weight of carrier. In such case, commonly known materials employed as magnetic particles of the carrier include metals such as iron, ferrite, magnetite and the like, and alloys made from these metals and other metals such as aluminum, lead and the like. Of these, ferrite is specifically preferred. A volume average particle diameter of the above magnetic particles is preferably 15-100 μm, and more preferably 25-80 μm.

The volume average particle diameter of a carrier can be measured employing a typical laser diffraction type particle distribution meter "HELOS" (manufactured by Sympatec Co, Ltd.) with a wet type homogenizer installed.

The carrier is preferably one in which magnetic particles are further coated by resin, or a so-called resin-dispersed type carrier in which magnetic particles are dispersed in resin. Resin compositions for coating are not particularly limited. Employed, for example, are an olefin based resin, a styrene based resin, a styrene-acryl based resin, a silicon based resin, an ester based resin, a fluorine containing polymer based resin, and such. Resins for making up the resin-dispersed type carrier are also not particularly limited, and commonly known resins can be employed. A styrene-acryl based resin, a polyester resin, a fluorine based resin, a phenol resin and so forth, for example, can be used.

EXAMPLE

Though the following examples are specifically explained, embodiments in the present invention are not limited thereto.

Example A

<<Preparation of Photoreceptor 1>>

(Support)

As shown in Table A-1, aluminum alloy drawn tubes (8 kinds) were prepared, and a mirror-finished surface process was carried out with a diamond tool after conducting an insert guide process at both tube ends. After support Nos. 1-6 were subjected to mirror-finished surface processing, a heat aging process was conducted at 240° C. for 1 hours. Support Nos. 7-8 were not subjected to heat treatment.

Aluminum tubes to which the above mirror-finished and aging processes were conducted were washed under the following conditions to prepare supports.

The 1$^{st}$ tank (Ultrasonic Washing)

An ultrasonic washing process was carried out for 60 seconds, employing a 5% aqueous solution of alkali detergent SE-115 produced by Sonic Fellow Co., Ltd. Incidentally, a 28 kHz ultrasonic oscillator was placed at both the bottom of and the lateral side of the tank. A combined oscillator of a rotation type and an oscillation type was used.

The $2^{nd}$ tank (Sponge Rubbing Washing)

A Belclean sponge (produced by Kanebo, Ltd) was rubbed in a tube, employing an aqueous solution of alkali detergent (the same case as the $1^{st}$ tank), and a rubbing washing process was carried out for 60 seconds while the sponge was rotated in the same direction of the tube, giving detergent shower.

The $3^{rd}$ tank (Rinsing)

A rinsing process was carried out for 60 seconds, employing pure water (25° C.) while a tank in the same case as the $1^{st}$ tank overflowed.

The $4^{th}$ tank (Rinsing)

the same case as the $3^{rd}$ tank.

The $5^{th}$ tank (Drying)

After hydration-oxidation treatment conducted via immersing in 80° C. ultrapure water for 1 minute, a tube was pulled up at a pull-up speed of 0.5 cm/sec, and dried in 25° C. warm air. In addition, support Nos. 5 and 6 were dried in 40° C. warm air.

Drawn tube Nos., the size of crystallizing material particles, and the number per (20 μm)$^2$ for support Nos. 1-8 are shown in Table A-1.

TABLE A-1

| Support | Drawn tube | | Crystallizing material particle | |
|---|---|---|---|---|
| | | | Major axis | Number per |
| No. | No. | Alloy material | length (μm): (a) | (20 μm)$^2$: (b) |
| 1 | 1 | Al—Mg(0.56 wt %)-Si (0.12%)system | 1-5 | 7 |
| 2 | 2 | Al—Mn(1.1%)system | 6-9 | 18 |
| 3 | 3 | Al—Mg(0.7%)system | 0.2-0.4 | 18 |
| 4 | 4 | Al—Mn(0.8%)system | 6-9 | 0.6 |
| 5 | 5 | Al—Mg(0.3%)system | 0.2-0.5 | 0.7 |
| 6 | 6 | Al—Mg(0.2%)system | up to 0.1 | 0.3 |
| 7 | 7 | Al—Mn(1.1%)system | 11-15 | 25 |
| 8 | 8 | Al—Mn(1.0%)system | 16-20 | 18 |

(a): Major axis length in the range obtained via 50 micrographs.
(b): The total number average.

(Formation of Intermediate Layer)

After the solution, in which the following components were mixed, was dispersed for 10 hours by a batch type sand mill, it was diluted by two times with the same mixed solvent. Subsequently, it remained untouched overnight, and was filtrated with a filter produced by Nippon Pall Ltd. (filtration accuracy: 5 μm at a pressure of 50 kPa) to prepare an intermediate layer coating liquid.

The above intermediate layer coating liquid was coated up to the end of support 1 by a dip coating method to form an intermediate layer coating film. After the intermediate layer coating film was peeled off up to 15 mm from the support end by a tape containing the following admixture solvent, and the support end was exposed, it was dried at 120° C. for 30 minutes to prepare a dry thickness of 5.0 μm. In addition, the layer thickness was measured by an eddy current system layer thickness measurement instrument, EDDY 560C, manufactured by HELMUT FISCHER GMBTE Co.

| | |
|---|---|
| Polyamide resin with a chemical structure of the foregoing N-9 | 1.0 part (1.0 part by volume) |
| Rutile type titanium oxide | 3.5 parts (1.0 part by volume) |
| Admixture solvent | 10 parts |

(Ethanol/n-propylalcohol/tetrahydrofuran = 45/20/30 in weight ratio)

(Ethanol/n-propylalcohol/tetrahydrofuran=45/20/30 in weight ratio)

(Formation of Charge Generation Layer)

The following components were mixed, dispersion was performed using a sand mill homogenizer, whereby charge generation layer coating liquid was produced. This coating liquid was coated up to the end of a support by a dip coating method to form a charge generation layer having a dry thickness of 0.3 μm provided on the above intermediate layer. Incidentally, the layer thickness was measured by an eddy current system layer thickness measurement instrument, EDDY 560C, manufactured by HELMUT FISCHER GMBTE Co.

| | |
|---|---|
| Y type oxytitanylphthalocyanine (a titanyl phthalocyanine pigment showing a maximum diffraction peak at Bragg angle (2θ ± 0.2°) 27.3° in the X-ray diffraction spectrum of the Cu-Kα characteristic X-ray) | 20 parts |
| Silicon modified polyvinyl butyral) | 10 parts |
| 4-methoxy-4-methyl-2-pentanone | 700 parts |
| t-butyl acetate | 300 parts |

(Formation of Charge Transfer Layer)

The following components were dissolved to prepare a charge transfer layer coating liquid. This coating liquid was coated on the foregoing charge generation layer up to the end of a support by the dip coating method to form a charge transfer layer having a dry thickness of 25 μm. Thus photoreceptor 1 having a photosensitive layer up to the end of a support was prepared. Incidentally, the layer thickness was measured by an eddy current system layer thickness measurement instrument, EDDY 560C, manufactured by HELMUT FISCHER GMBTE Co.

| | |
|---|---|
| 4-methoxy-4'-(4-methyl-α-phenylstyryl)triphenylamine | 70 parts |
| Bisphenol Z type polycarbonate IUPIRON-Z300 (Mitsubishi Gas Kagaku Co., Ltd.) | 100 parts |
| Antioxidant IRGANOX1010 (manufactured by Nihon Chiba Geigy) | 8 parts |
| Tetrahydrofuran/toluene (8/2 in volume ratio) | 750 parts |

(Peeling Off of Photosensitive Layer)

The above prepared photosensitive layer in "photoreceptor 1 having a photosensitive layer up to the end of a support" was peeled off up to 10 mm from the support end by a tape containing an admixture solvent of tetrahydrofuran and t-butyl acetate (50%/50% by weight), and photoreceptor 1 in which 5 mm of the intermediate layer was covered by the photosensitive layer was prepared.

<<Preparation of Photoreceptors 2-5 and 7-14>>

Photoreceptors 2-5 and 7-14 were similarly prepared, except that support 1 and inorganic particles used for preparing the foregoing photoreceptor 1 were replaced, as shown in Table A-2 (corresponding to FIG. 1(*c*)).

<<Preparation of Photoreceptor 6>>

The above prepared photosensitive layer in "photoreceptor 1 having a photosensitive layer up to the end of a support" was peeled off up to 15 mm from the support end by a tape containing an admixture solvent of tetrahydrofuran and t-butyl acetate (50%/50% by weight), and photoreceptor 6, in which the intermediate layer and the photosensitive layer were placed approximately at the same position, was prepared (corresponding to FIG. 1(*b*)).

<<Preparation of Photoreceptor 15>>.

Photoreceptors 15 was similarly prepared, except that inorganic particles (Rutile type titanium oxide) used for preparing the above photoreceptor 1 were not added, as shown in Table A-2 (corresponding to FIG. 1(*c*)).

<<Preparation of Photoreceptor 16>>

The above prepared photosensitive layer in "photoreceptor 1 having a photosensitive layer up to the end of a support" was peeled off up to 20 mm from the support end by a tape containing an admixture solvent of tetrahydrofuran and t-butyl acetate (50%/50% by weight), and photoreceptor 16, in which the intermediate layer was exposed 5 mm from the end of the photosensitive layer, was prepared (corresponding to FIG. 2(*e*)).

Supports, inorganic particles, the number average primary particle diameter, and layer structures which are used for preparing photoreceptors 1-16 are shown in Table A-2. In addition, the number average primary particle diameter is a measured value obtained via the foregoing measuring method.

TABLE A-2

| | | Intermediate layer | | |
|---|---|---|---|---|
| Photo-receptor No. | Support No. | Inorganic particle | Number average primary particle diameter (nm) | Layer structure |
| 1 | 1 | Rutile type titanium oxide | 33 | FIG. 1(d) |
| 2 | 2 | Rutile type titanium oxide | 33 | FIG. 1(d) |
| 3 | 3 | Rutile type titanium oxide | 33 | FIG. 1(d) |
| 4 | 4 | Rutile type titanium oxide | 33 | FIG. 1(d) |
| 5 | 5 | Rutile type titanium oxide | 33 | FIG. 1(d) |
| 6 | 1 | Rutile type titanium oxide | 7 | FIG. 1(b) |
| 7 | 1 | Anatase type titanium oxide | 280 | FIG. 1(d) |
| 8 | 1 | Surface-treated titanium oxide *1 | 35 | FIG. 1(d) |
| 9 | 1 | Zinc oxide | 50 | FIG. 1(d) |
| 10 | 6 | Rutile type titanium oxide | 33 | FIG. 1(d) |
| 11 | 7 | Rutile type titanium oxide | 33 | FIG. 1(d) |
| 12 | 8 | Rutile type titanium oxide | 33 | FIG. 1(d) |
| 13 | 1 | Rutile type titanium oxide | 3 | FIG. 1(d) |
| 14 | 1 | Rutile type titanium oxide | 400 | FIG. 1(d) |

TABLE A-2-continued

| | | Intermediate layer | | |
|---|---|---|---|---|
| Photo-receptor No. | Support No. | Inorganic particle | Number average primary particle diameter (nm) | Layer structure |
| 16 | 1 | — | — | FIG. 1(d) |
| 16 | 1 | Surface-treated titanium oxide *1 | 35 | FIG. 2(e) |

*1: Surface treatment was carried out by the amount of 5 wt %, based on the total weight of titanium oxide, employing methylhydrogen siloxane and dimethyl siloxane copolymer (1:1 in mol %).

<<Evaluation>>

An image forming apparatus illustrated in FIG. 3 was used as an evaluation apparatus.

Loading this image forming apparatus with the foregoing photoreceptors 1-16 one after another, 100,000 copies were continuously printed under heavy-duty conditions of high temperature and high humidity (30° C. and 80% RH).

In relation to film peeling of a photosensitive layer, damages of a cleaning blade, and toner adhesion, the photoreceptor and the cleaning blade were visually observed, to be evaluated.

The evaluation of images was carried out via toner images in which an original image, comprised of equals of one quarter of each of a text pattern image with a 7% pixel ratio, a color human portrait (a dot image including a halftone image), a solid white image and a solid black image, was printed employing A4 neutralized paper sheets.

<Visual Observation>

(Film Peeling of Photosensitive Layer)

In relation to film peeling of a photosensitive layer, the photoreceptor after printing 100,000 copies continuously was visually observed, and the evaluation concerning film peeling at the end of the photosensitive layer was made.

Evaluation Criteria

A: No film peeling at the end of the photosensitive layer is observed.

B: Film peeling at the end of the photosensitive layer is observed.

(Damages of Cleaning Blade and Toner Adhesion)

In relation to damage of a cleaning blade and the toner adhesion, the cleaning blade after printing 100,000 copies was removed, and damage of the cleaning blade and the toner adhesion at the end of a coated layer in the photoreceptor were visually observed.

Evaluation Criteria

A: Neither damage of a cleaning blade nor the toner adhesion was observed.

B: At least damage of a cleaning blade or the toner adhesion was observed.

<Image Evaluation>

(Fog)

In relation to fog, density of non-printed sheets (blank sheet) at 20 places was measured in absolute image density, the average value is set to blank sheet density. Subsequently, a blank portion of an evaluation sheet, in which a blank image has been formed, was similarly measured in absolute image density, and the value obtained by subtracting the foregoing blank density from the average density was evaluated as the fog. The measurement was carried out with a Macbeth RD-918 densitometer.

Evaluation Criteria

A: Not more than 0.05 both at the beginning of printing and after printing 100,000 copies (an excellent level)

B: Not more than 0.05 at the beginning of printing and not more than 0.01 after printing 100,000 copies (a practically satisfactory level)

C: More than 0.01 both at the beginning of printing and after printing 100,000 copies (a practically unsatisfactory level)

(Black Spot)

In relation to black spots, 100 copies of a blank image were printed after printing 100,000 copies under the conditions of high temperature and high humidity (30° C. and 80% RH), to be evaluated.

Black spots have a periodicity conforming with a cycle of a photoreceptor, and were judged by how many black spots per A4 size which can visually be observed, to be evaluated.

Evaluation Criteria

A: Black spot frequency: not more than 3 pieces/A4 size in all printed images (an excellent level).

B: Black spot frequency: not less than 4 pieces/A4 size and not more than 10 pieces/A4 size; occurrence of one or more sheets (a practically satisfactory level).

C: Black spot frequency: not less than 11 pieces/A4 size; occurrence of one or more sheets (a practically unsatisfactory level).

(Image Density)

Image density was evaluated in printed image density at the solid black portion. The measurement was carried out in relative reflective density by setting the reflective density of a paper sheet to 0, employing a Macbeth RD-918 densitometer.

Evaluation Criteria

A: Not less than 1.2 both at the beginning of printing and after printing 100,000 copies (an excellent level)

B: Not less than 1.2 at the beginning of printing and not less than 1.0 after printing 100,000 copies (a practically satisfactory level)

C: Less than 1.0 both at the beginning of printing and after printing 100,000 copies (a practically unsatisfactory level)

(Sharpness)

In relation to sharpness, a character image (3 points and 5 points in character) was printed after printing 100,000 copies under the conditions of high temperature and high humidity (30° C. and 80% RH), and the text image was visually observed, to be evaluated.

Evaluation Criteria

A: Characters of both 3 points and 5 points are printed definitely to read easily; (an excellent level).

B: Characters of 5 points are printed definitely to read easily, and part of characters of 3 points are not printed definitely to read partly with slight difficulty (a practically satisfactory level).

C: No characters of both 3 points and 5 points are printed definitely to read partly or totally with great difficulty (a practically satisfactory level).

The evaluated results are shown in Table A-3.

TABLE A-3

| | Photo-receptor No. | Film peeling of photo-sensitive layer | Damage of Cleaning blade and toner adhesion | Image evaluation | | | |
|---|---|---|---|---|---|---|---|
| | | | | Fog | Image density | Sharpness | Black spot |
| Example 1 | 1 | A | A | A | A | A | A |
| Example 2 | 2 | A | A | A | A | A | A |
| Example 3 | 3 | A | A | A | A | B | A |
| Example 4 | 4 | A | A | A | A | A | A |
| Example 5 | 5 | A | A | A | A | A | B |
| Example 6 | 6 | A | A | A | B | A | A |
| Example 7 | 7 | A | A | A | A | A | A |
| Example 8 | 8 | A | A | A | A | A | A |
| Example 9 | 9 | A | A | A | A | A | A |
| Comparative example 1 | 10 | B | A | B | B | C | C |
| Comparative example 2 | 11 | A | B | B | C | C | C |
| Comparative example 3 | 12 | A | A | C | C | C | C |
| Comparative example 4 | 13 | A | A | C | C | B | C |
| Comparative example 5 | 14 | A | A | C | C | B | C |
| Comparative example 6 | 15 | A | A | C | B | C | C |
| Comparative example 7 | 16 | B | B | C | B | B | C |

It is to be understood in Table A-3 that Comparative examples 1-7 possess a problem in at least any of the above evaluation items, though Examples 1-9 exhibit excellent properties in any of the above evaluation items.

Example B

<<Preparation of Photoreceptor 17>>

(Support)

The same aluminum support as the foregoing photoreceptor 1 was used.

(Formation of Intermediate Layer)

After the solution, in which the following components were mixed, was dispersed for 10 hours by a batch type sand mill, it was diluted by two times with the same mixed solvent. Subsequently, it remained untouched overnight, and was filtrated with a filter produced by Nippon Pall Ltd. (filtration accuracy: 5 μm at a pressure of 50 kPa) to prepare an intermediate layer coating liquid.

The above intermediate layer coating liquid was coated up to 15 mm from the upper end of a support, adjusting immersion depth via immersion coating, and dried to form an intermediate layer. After the intermediate layer coating film was removed up to 15 mm from the support end by a tape containing the following admixture solvent, and the support end was exposed, it was heat-treated at 120° C. for 30 minutes to prepare a dry thickness of 3.0 μm. In addition, the layer thickness was measured by an eddy current system layer thickness measurement instrument, EDDY 560C, manufactured by HELMUT FISCHER GMBTE Co.

| | |
|---|---|
| Polyamide resin with a chemical structure of the foregoing N-9 | 1.0 part (1.0 part by volume) |
| Rutile type titanium oxide | 3.5 parts (1.0 part by volume) |
| Admixture solvent | 10 parts |

(Ethanol/n-propylalcohol/tetrahydrofuran = 45/20/30 in weight ratio)

(Formation of Charge Generation Layer)

The following compositions were mixed, dispersion was performed using a sand mill homogenizer, whereby charge generation layer coating liquid was produced.

This intermediate layer coating liquid was coated up to 15 mm from the upper end of a support, adjusting immersion depth via immersion coating, and dried to form a charge generation layer.

After the intermediate layer coating film was removed up to 13 mm from the lower end of a support by a tape containing the following admixture solvent, the lower end of the support was exposed, and a charge generation layer having a thickness of 3.0 μm was formed on the foregoing intermediate layer. In addition, the layer thickness was measured by an eddy current system layer thickness measurement instrument, EDDY 560C, manufactured by HELMUT FISCHER GMBTE Co.

| | |
|---|---|
| Y type oxytitanylphthalocyanine (a titanyl phthalocyanine pigment showing a maximum diffraction peak at Bragg angle (2θ ± 0.2°) 27.3° in the X-ray diffraction spectrum of the Cu-Kα characteristic X-ray) | 20 parts |

-continued

| | |
|---|---|
| 4-methoxy-4-methyl-2-pentanone | 700 parts |
| t-butyl acetate | 300 parts |

(Formation of Charge Transfer Layer)

The following components were dissolved to prepare a charge transfer layer coating liquid.

This charge transfer layer coating liquid was coated up to 10 mm from the upper end of a support, adjusting immersion depth via immersion coating, and dried to form a charge transfer layer.

After the charge transfer layer coating film was removed up to 10 mm from the lower end of a support by a tape containing the following admixture solvent, the lower end of the support was exposed, and a charge transfer layer having a thickness of 25 μm was formed on the above charge generation layer, to prepare photoreceptor 17 (corresponding to FIG. 4(*d*)). In addition, the layer thickness was measured by an eddy current system layer thickness measurement instrument, EDDY 560C, manufactured by HELMUT FISCHER GMBTE Co.

| | |
|---|---|
| 4-methoxy-4'-(4-methyl-α-phenylstyryl)triphenylamine | 70 parts |
| Polyarylate (Exemplified compound P-1) | 100 parts |
| Antioxidant IRGANOX1010 (manufactured by Nihon Chiba Geigy) | 8 parts |
| Tetrahydrofuran/toluene (8/2 in volume ratio) | 750 parts |

<<Preparation of Photoreceptor 18>>

The following protective layer coating liquid was coated on the surface of photoreceptor 17 prepared above, employing a circular slide hopper coating apparatus, and dried to form a protective layer having a thickness of 3 μm.

(Preparation of Protective Layer)

The following components were dissolved to prepare a protective layer coating liquid.

| | |
|---|---|
| 4-methoxy-4'-(4-methyl-α-phenylstyryl)triphenylamine | 40 parts |
| Polyarylate (Exemplified compound P-1) | 100 parts |
| Antioxidant IRGANOX1010 (manufactured by Nihon Chiba Geigy) | 8 parts |
| Tetrahydrofuran/toluene (8/2 in volume ratio) | 750 parts |

After the protective layer coating film was removed up to 10 mm from both ends of a support by a tape containing the solvent (tetrahydrofuran/toluene (8/2 in volume ratio)), the ends of the support were exposed, to prepare photoreceptor 18 (corresponding to FIG. 4(*e*)). In addition, the layer thickness was measured by an eddy current system layer thickness measurement instrument, EDDY 560C, manufactured by HELMUT FISCHER GMBTE Co.

<<Preparation of Photoreceptors 19-21 and 23-28>>

Photoreceptors 19-21 and 23-28 were similarly prepared, except that a binder resin contained in the charge generation layer and inorganic particles contained in the intermediate layer which were employed for preparing Photoreceptor 17 were replaced as shown in Table B-2 (corresponding to FIG. 4(*d*).

<<Preparation of Photoreceptor 22>>

The charge transfer layer in photoreceptor 17 prepared above was removed up to 13 mm from both ends of a support by a tape containing an admixture solvent of tetrahydrofuran and t-butyl acetate (50%/50% by weight), and photoreceptor 22 in which the ends of the intermediate layer and the photosensitive layer are approximately at the same position was prepared (corresponding to FIG. 4(*b*)).

<<Preparation of Photoreceptor 29>>

Photoreceptor 29 was similarly prepared, except that inorganic particles employed for preparing an intermediate layer of photoreceptor 17 were not added (corresponding to FIG. 4(*d*)).

<<Preparation of Photoreceptor 30>>

The photosensitive layer in photoreceptor 17 prepared above was removed up to 20 mm from both ends of a support by a tape containing an admixture solvent of tetrahydrofuran and t-butyl acetate (50%/50% by weight), and photoreceptor 30, in which the intermediate layer was exposed 5 mm beyond the end of the photosensitive layer, was prepared (corresponding to FIG. 5(*f*)).

Binder resins, inorganic particles, the number average primary particle diameter, and layer structures are shown in Table B-1. Incidentally, the number average primary particle diameter is the value obtained via the foregoing measuring method.

TABLE B-1

| | Intermediate layer | | Photo-sensitive layer | | |
|---|---|---|---|---|---|
| Photo-receptor No. | Inorganic particles | Number average primary particle diameter | (charge transfer layer) Binder resin | Protective layer Binder resin | Layer structure |
| 17 | Rutile type titanium oxide | 33 | Exemplified compound P-1 | — | FIG. 4(d) |
| 18 | Rutile type titanium oxide | 33 | Exemplified compound P-1 | Exem-plified compound P-1 | FIG. 4(e) |
| 19 | Rutile type titanium oxide | 33 | Exemplified compound P-4 | — | FIG. 4(d) |
| 20 | Rutile type titanium oxide | 33 | Exemplified compound P-21 | — | FIG. 4(d) |
| 21 | Rutile type titanium oxide | 33 | Exemplified compound P-24 | — | FIG. 4(b) |
| 22 | Rutile type titanium oxide | 7 | Exemplified compound P-1 | — | FIG. 4(d) |
| 23 | anatase type titanium oxide | 280 | Exemplified compound P-1 | — | FIG. 4(d) |
| 24 | Surface-treated titanium oxide *1 | 35 | Exemplified compound P-1 | — | FIG. 4(d) |
| 25 | Zinc oxide | 50 | Exemplified compound P-1 | — | FIG. 4(d) |
| 26 | Rutile type titanium oxide | 33 | PANLITE 1250 *2 | — | FIG. 4(d) |
| 27 | Rutile type titanium oxide | 3 | Exemplified compound P-1 | — | FIG. 4(d) |
| 28 | Rutile type titanium oxide | 400 | Exemplified compound P-1 | — | FIG. 4(d) |
| 29 | — | — | Exemplified compound P-1 | — | FIG. 4(d) |
| 30 | Surface-treated titanium oxide *1 | 35 | Exemplified compound P-1 | — | FIG. 5(f) |

*1: Surface treatment was carried out by the amount of 5 wt %, based on the total weight of titanium oxide, employing methylhydrogen siloxane and dimethyl siloxane copolymer (1:1 in mol %).
*2: Bisphenol A polycarbonate, produced by Teijin Chemicals Ltd.

<<Evaluation>>

The image forming apparatus shown in FIG. 3 is used as an evaluation apparatus.

Loading this image forming apparatus with the foregoing photoreceptors 17-30 one after another, 100,000 copies were continuously printed at normal temperature and humidity (23° C. and 60% RH).

In relation to film peeling of a photosensitive layer, damages of a cleaning blade, and toner adhesion, the photoreceptor and the cleaning blade were visually observed, to be evaluated.

The evaluation of images was carried out via toner images in which an original image, comprised of equals of one quarter of each of a text pattern image with a 7% pixel ratio, a color human portrait (a dot image including a halftone image), a solid white image and a solid black image, was printed employing A4 neutralized paper sheets.

<Visual Observation>

(Film Peeling of Coated Layer)

In relation to film peeling of a coated layer, the photoreceptor after printing 100,000 copies continuously was visually observed, and the evaluation concerning film peeling at the end of the coated layer was made.

Evaluation Criteria

A: No film peeling at the end of the photosensitive layer is observed.

B: Film peeling at the end of the photosensitive layer is observed.

(Solvent Crack Characteristic)

The solvent crack characteristic indicates ease of occurrence of damages caused by skin oil or fingerprints, and it affects film peeling of a coated layer. In relation to the solvent crack characteristic, skin oil is attached on the surface of a specimen, and the specimen remains untouched for 48 hours. Subsequently, presence or non-presence of solvent cracks were observed employing an electron microscope.

Evaluation Criteria

A: Solvent cracks are observed.

B: No solvent crack is observed.

(Damages of Cleaning Blade and Toner Adhesion)

In relation to damage of a cleaning blade and the toner adhesion, the cleaning blade after printing 100,000 copies was removed, and damage of the cleaning blade and the toner adhesion at the end of a coated layer in the photoreceptor were visually observed.

Evaluation Criteria

A: Neither damage of a cleaning blade nor the toner adhesion was observed.

B: At least damage of a cleaning blade or the toner adhesion was observed.

<Image Evaluation>

(Fog)

In relation to fog, density of non-printed sheets (blank sheet) at 20 places was measured in absolute image density, the average value is set to blank sheet density. Subsequently, a blank portion of an evaluation sheet, in which a blank image has been formed, was similarly measured in absolute image density, and the value obtained by subtracting the foregoing blank density from the average density was evaluated as the fog. The measurement was carried out with a Macbeth RD-918 densitometer.

Evaluation Criteria

A: Not more than 0.05 both at the beginning of printing and after printing 100,000 copies (an excellent level)

B: Not more than 0.05 at the beginning of printing and not more than 0.01 after printing 100,000 copies (a practically satisfactory level)

C: More than 0.01 both at the beginning of printing and after printing 100,000 copies (a practically unsatisfactory level)

(Black Spot)

In relation to black spots, 100 copies of a blank image were printed after printing 100,000 copies at normal temperature and humidity (23° C. and 60% RH), to be evaluated.

Black spots have a periodicity conforming with a cycle of a photoreceptor, and were judged by how many black spots per A4 size which can visually be observed, to be evaluated.

Evaluation Criteria

A: Black spot frequency: not more than 3 pieces/A4 size in all printed images (an excellent level).

B: Black spot frequency: not less than 4 pieces/A4 size and not more than 10 pieces/A4 size; occurrence of one or more sheets (a practically satisfactory level).

C: Black spot frequency: not less than 11 pieces/A4 size; occurrence of one or more sheets (a practically unsatisfactory level).

(Image Density)

Image density was evaluated in printed image density at the solid black portion. The measurement was carried out in relative reflective density by setting the reflective density of a paper sheet to 0, employing a Macbeth RD-918 densitometer.

Evaluation Criteria

A: Not less than 1.2 both at the beginning of printing and after printing 100,000 copies (an excellent level)

B: Not less than 1.2 at the beginning of printing and not less than 1.0 after printing 100,000 copies (a practically satisfactory level)

C: Less than 1.0 both at the beginning of printing and after printing 100,000 copies (a practically unsatisfactory level)

(Sharpness)

In relation to sharpness, a character image (3 points and 5 points in character) was printed after printing 100,000 copies at normal temperature and humidity (23° C. and 60% RH), and the text image was visually observed, to be evaluated.

Evaluation Criteria

A: Characters of both 3 points and 5 points are printed definitely to read easily; (an excellent level).

B: Characters of 5 points are printed definitely to read easily, and part of characters of 3 points are not printed definitely to read partly with slight difficulty (a practically satisfactory level).

C: No characters of both 3 points and 5 points are printed definitely to read partly or totally with great difficulty (a practically satisfactory level).

The evaluated results are shown in Table B-2.

TABLE B-2

| | Photo-receptor No. | Visual observation or electron microscope observation: Film peeling of coated layer | Solvent Crack | Damage of Cleaning blade and toner adhesion | Image evaluation: Fog | Image density | Sharpness | Black spot |
|---|---|---|---|---|---|---|---|---|
| Ex. 17 | 17 | A | A | A | A | A | A | A |
| Ex. 18 | 18 | A | A | A | A | A | A | A |
| Ex. 19 | 19 | A | A | A | A | A | B | A |
| Ex. 20 | 20 | A | A | A | A | A | A | A |
| Ex. 21 | 21 | A | A | A | A | A | A | B |
| Ex. 22 | 22 | A | A | A | A | B | A | A |
| Ex. 23 | 23 | A | A | A | A | A | A | A |

TABLE B-2-continued

| | Photo-receptor No. | Visual observation or electron microscope observation: Film peeling of coated layer | Solvent Crack | Damage of Cleaning blade and toner adhesion | Image evaluation: Fog | Image density | Sharpness | Black spot |
|---|---|---|---|---|---|---|---|---|
| Ex. 24 | 24 | A | A | A | A | A | A | A |
| Ex. 25 | 25 | A | A | A | A | A | A | B |
| Ex. 26 | 26 | A | A | A | B | B | B | B |
| Comp. Ex. 8 | 27 | A | A | A | C | C | B | C |
| Comp. Ex. 9 | 28 | A | A | A | C | B | C | C |
| Comp. Ex. 10 | 29 | A | B | A | C | B | C | C |
| Comp. Ex. 11 | 30 | B | A | B | C | B | B | C |

Ex.: Example
Comp.: Comparative

It is to be understood in Table B-2 that Comparative examples 8-11 possess a problem in at least any of the above evaluation items, though Examples 17-26 exhibit excellent properties in any of the above evaluation items.

In addition, Examples 17-26 can also provide excellent results to any of these evaluation items, even though an image forming apparatus with a commercially available contact charging means is used.

[Effect of the Invention]

It is to be understood that the photoreceptor, the image forming method, the image forming apparatus, and the processing cartridge of the present invention exhibit an excellent effect on high quality toner images with no toner adhesion and damages of a cleaning blade after a lot of printing, and with no image defect caused by occurrence of fog, lowered image density and sharpness, or generation of black spots.

What is claimed is:

1. An electrophotographic photoreceptor comprising an electrically conductive support containing aluminum, an a photosensitive layer, and at least an intermediate layer containing inorganic particles and binder, the intermediate layer being provided between the support and the photosensitive layer, wherein the support has on a surface of the support crystallizing material particles having a diameter of 0.3-10 μm in an amount of being 0.5-20 per $(20\ \mu m)^2$, the inorganic particles have a number average primary particle diameter of 5-300 nm, the intermediate layer is an insulating layer the entire intermediate layer including at least one end of the intermediate layer is substantially covered by the photosensitive layer, and wherein the photosensitive layer directly adheres to the support.

2. The electrophotographic photoreceptor of claim 1, wherein the photosensitive layer contains a polyarylate resin or a polyarylate copolymer resin.

3. The electrophotographic photoreceptor of claim 1, wherein the inorganic particles are N-type semiconductive particles.

4. The electrophotographic photoreceptor of claim 1, wherein the inorganic particles comprise inorganic oxides.

5. The electrophotographic photoreceptor of claim 1, wherein the inorganic particles comprise titanium oxides.

6. The electrophotographic photoreceptor of claim 1, wherein the inorganic particles are subjected to surface treatment.

7. The electrophotographic photoreceptor of claim 1, wherein the intermediate layer has a thickness of 0.2-40μm.

8. The electrophotographic photoreceptor of claim 1, wherein the binder comprises polyamide resin.

9. The electrophotographic photoreceptor of claim 1, wherein the photosensitive layer has at least a charge generation layer and a charge transfer layer provided on the intermediate layer in this order.

10. The electrophotographic photoreceptor of claim 1, wherein a protective layer is provided on the photosensitive layer.

11. An electrophotographic image forming method comprising the steps of:

(a) charging an electrophotographic photoreceptor as defined in claim 1, (b) exposing the charged electrophotographic photoreceptor to form an electrostatic latent image, (c) developing the electrostatic latent image with a developer containing a toner to form a toner image, and (d) transferring the toner image to a recording material.

12. The electrophotographic image forming method of claim 11, wherein the photosensitive layer contains a polyarylate resin or a polyarylate copolymer resin.

13. The electrophotographic image forming method of claim 11, wherein a charging member is brought into contact with the electrophotographic photoreceptor to be charged in the charging step.

14. The electrophotographic image forming method of claim 13, wherein the charging member is a charging roller.

15. The electrophotographic image forming method of claim 13, wherein the charging member is a magnetic brush.

16. An electrophotographic image forming apparatus comprising the electrophotographic photoreceptor of claim 1.

17. A processing cartridge capable of being mounted on and dismounted from an electrophotographic image forming apparatus, comprising the electrophotographic photoreceptor of claim 1 and at least one of a charging device, an exposure device, a development device, a transfer device and a cleaning device.

18. The electrophotographic photoreceptor of claim 13, wherein the protective layer contains a polyarylate resin or a polyacrylate copolymer resin.

19. The electrophotographic image forming method of claim 11, wherein the electrophotographic photoreceptor is defined by claim 10 and the protective layer contains a polyarylare resin or a polyarylate copolymer resin.

* * * * *

UNITED STATES PATENT AND TRADEMARK OFFICE

CERTIFICATE OF CORRECTION

PATENT NO. : 7,608,372 B2
APPLICATION NO. : 11/259243
DATED : October 27, 2009
INVENTOR(S) : Ishida et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 527 days.

Signed and Sealed this

Twelfth Day of October, 2010

David J. Kappos

David J. Kappos
*Director of the United States Patent and Trademark Office*